US010667042B2

(12) United States Patent
Frenchik, Jr.

(10) Patent No.: US 10,667,042 B2
(45) Date of Patent: May 26, 2020

(54) MICROPHONE MOUNT MECHANICAL ISOLATOR

(71) Applicant: Michael H. Frenchik, Jr., Calabasas, CA (US)

(72) Inventor: Michael H. Frenchik, Jr., Calabasas, CA (US)

( * ) Notice: Subject to any disclaimer, the term of this patent is extended or adjusted under 35 U.S.C. 154(b) by 140 days.

(21) Appl. No.: 15/833,628

(22) Filed: Dec. 6, 2017

(65) Prior Publication Data

US 2018/0160221 A1 Jun. 7, 2018

Related U.S. Application Data

(60) Provisional application No. 62/431,266, filed on Dec. 7, 2016.

(51) Int. Cl.
*H04R 1/28* (2006.01)
*H04R 1/08* (2006.01)

(52) U.S. Cl.
CPC ..... *H04R 1/2892* (2013.01); *H04R 1/08* (2013.01); *H04R 1/083* (2013.01)

(58) Field of Classification Search
CPC ..... H04R 1/08; H04R 1/2892
USPC ..... 381/91, 122, 324, 355, 361, 366, 368, 381/375
See application file for complete search history.

(56) References Cited

U.S. PATENT DOCUMENTS 1,607,769 A 5/1925 Meyer
2,174,747 A 12/1936 Hueglin
2,145,655 A 1/1939 Hueglin
3,573,401 A 4/1971 Lininger
3,653,625 A * 4/1972 Plice ..... F16F 15/0232 267/113
4,038,500 A 7/1977 Frye
4,466,596 A 8/1984 Cohen
4,955,578 A 9/1990 Fidi
5,031,872 A 7/1991 Vance et al.
5,942,735 A 8/1999 Liang
5,988,585 A * 11/1999 Eaton ..... H04R 1/08 248/559
6,226,386 B1 5/2001 Akino
6,459,802 B1 10/2002 Young
6,590,989 B2 7/2003 Chen
6,682,043 B1 1/2004 Hsieh
7,182,324 B2 2/2007 Baumhauer, Jr. et al.
D630,191 S 1/2011 Chang et al.
8,477,982 B2 7/2013 Reginaldo
D705,761 S 5/2014 McGovern, Jr. et al.
D706,245 S 6/2014 McGovern, Jr. et al.

OTHER PUBLICATIONS

Neumann Z 26 MT Inline Microphone Shock Mount ; site visited Nov. 30, 2017.
http://www.shure.com/americas/search?accessories=Microphones&category_1=Microphones ; discloses various microphone mounts; 2009 TO 2017 ; Site visited: Dec. 3, 2017.

(Continued)

*Primary Examiner* — Yosef K Laekemariam

(74) *Attorney, Agent, or Firm* — Peter Ganjian; Patent Law Agency, LLC

(57) ABSTRACT

Universal mechanical isolator that effectively decouples a vibration sensitive device such as a microphone from a support to thereby isolate the vibration sensitive device from mechanical vibrations.

20 Claims, 27 Drawing Sheets

(56) References Cited

OTHER PUBLICATIONS https://en-us.sennheiser.com/v4r/global_search?q=MZS-100 ; discloses various microphone mounts; site visited: Dec. 3, 2017.
http://www.thefeltstore.com/Portal.aspx?CN=D1362646313E ; The Felt Store; sit visited: Oct. 20, 2016.
https://www.sorbothane.com/ ; site visited: Oct. 20, 2016.
https://www.neumann.com/?lang=en&id=current_accessories&cid=db_current_accessories&dbid=35 ; Shock mount Z 26 mt ; site visited: Dec. 6, 2017.

* cited by examiner

MICROPHONE MOUNT MECHANICAL ISOLATOR

CROSS-REFERENCE TO RELATED APPLICATIONS

This Application claims the benefit of priority of U.S. Utility Provisional Patent Application 62/431,266, filed 7 Dec. 2016, the entire disclosure of which is expressly incorporated by reference in its entirety herein.

All documents mentioned in this specification are herein incorporated by reference to the same extent as if each individual document was specifically and individually indicated to be incorporated by reference.

It should be noted that throughout the disclosure, where a definition or use of a term in any incorporated document(s) is inconsistent or contrary to the definition of that term provided herein, the definition of that term provided herein applies and the definition of that term in the incorporated document(s) does not apply.

BACKGROUND OF THE INVENTION

Field of the Invention

One or more embodiments of the present invention are related to a mechanical isolator and in particular, to a universal mechanical isolator that absorbs and dampens shock, microphone noise frequency, and vibration.

Description of Related Art

Conventional microphone mounts that absorb or dampen shock, vibration, and microphone noise frequencies are well known and have been in use for a number of years. Absorption or dampening of vibration results in a better, more clear recording.

Regrettably, most conventional microphone mounts are uniquely and specifically manufactured to be used with a specifically and correspondingly matching Original Equipment Manufacturer (OEM) microphone. Additionally, most conventional microphone mounts that absorb or dampen shock, vibration, and microphone noise frequencies are very complex and costly to manufacture and use, and in most cases, are not interchangeable.

Further, unfortunately, most existing after market shock or vibration dampening devices today limit the type of microphones that may be used in terms of weight or orientation of microphones. For example, they may have an upper weight limit of only a few ounces (e.g., 5 to 10 ounces) and require that the after marked dampener be used linearly, vertically and inline and perpendicular to a stand.

Accordingly, in light of the current state of the art and the drawbacks to current microphone mounts mentioned above, a need exists for a universal mechanical isolator for a microphone that would absorb and dampen shock, microphone noise frequency, and vibration. Additionally, a need exists for a universal mechanical isolator that would be simple to manufacture, use, and would be low cost. Further, a need exists for a universal mechanical isolator that would allow the use of heavier weight microphones (e.g., upwards of 50 ounces or more) mounted in any orientation (sideways, upside down, etc.).

BRIEF SUMMARY OF THE INVENTION

A non-limiting, exemplary aspect of an embodiment of the present invention provides a vibration dampening device, comprising:

a universal mechanical isolator that effectively decouples a vibration sensitive device from a support to thereby isolate the vibration sensitive device from mechanical vibrations;

the universal mechanical isolator includes:

a first rigid piece associated with the vibration sensitive device;

a second rigid piece associated with the support; and a resilient middle piece that is positioned between and connected and sewn to the first rigid piece and to the second rigid piece by a thread, with the resilient middle piece absorbing mechanical vibrations.

Another non-limiting, exemplary aspect of an embodiment of the present invention provides a vibration dampening device, comprising:

a universal mechanical isolator that effectively decouples a microphone from a microphone stand to thereby isolate the microphone from mechanical vibrations;

the universal mechanical isolator includes:

a first rigid piece associated with the microphone;

a second rigid piece associated with the microphone stand; and a resilient middle piece that is positioned between and connected to the first rigid piece and to the second rigid piece, with the resilient middle piece absorbing mechanical vibrations;

the resilient middle piece is mechanically connected and fixed to the first and the second rigid pieces by a thread along a periphery edge of the first and the second rigid piece.

Still another non-limiting, exemplary aspect of an embodiment of the present invention provides a vibration dampening device, comprising:

a universal mechanical isolator that effectively decouples a microphone from a microphone stand to thereby isolate the microphone from mechanical vibrations;

the universal mechanical isolator includes:

a first rigid piece associated with the microphone;

a second rigid piece associated with the microphone stand; and a low profile resilient middle piece that is positioned between and connected to the first rigid piece and to the second rigid piece, with the resilient middle piece absorbing mechanical vibrations;

the first rigid piece and the second rigid piece include a base with plurality of openings positioned in a circular arrangement and aligned within a trough on a first side of the base;

the resilient middle piece is mechanically connected and fixed to the first and the second rigid pieces by a thread that is sewn through the plurality of the openings.

Yet another non-limiting, exemplary aspect of an embodiment of the present invention provides a vibration dampening device, comprising:

a universal mechanical isolator that includes:

a first rigid piece;

a second rigid piece; and a resilient middle piece that is positioned between and connected to the first rigid piece and to the second rigid piece by one or more flexible connector along a periphery of first rigid piece, second, rigid piece, and resilient middle piece, with the resilient middle piece and one or more flexible connector absorbing mechanical vibrations.

These and other features and aspects of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" may be used to mean "serving as an example, instance, or illustration," but the absence of the term "exemplary" does not denote a limiting embodiment. Any embodiment described as "exemplary" is not necessarily to be construed as preferred or advantageous over other embodiments. In the drawings, like reference character(s) present corresponding part(s) throughout.

DETAILED DESCRIPTION OF THE INVENTION

Figure 1B:
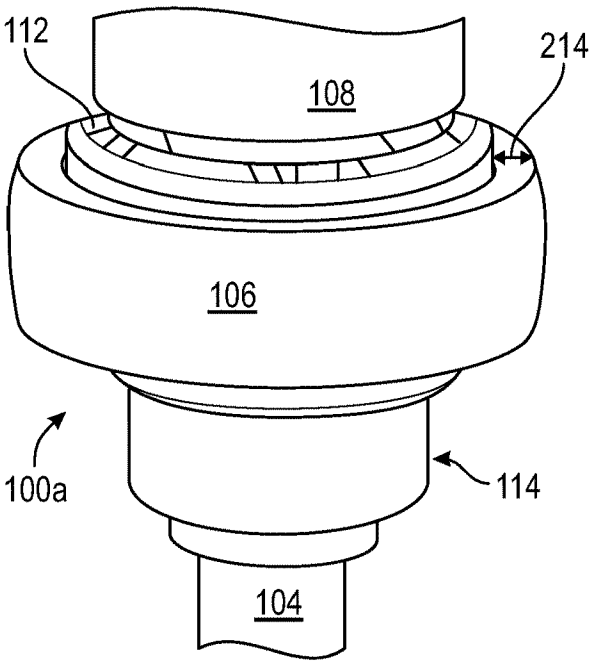
FIGS. 1A to 7D are non-limiting, exemplary illustration of a universal mechanical isolator in accordance with one or more embodiments of the present invention.
Figure 1A:
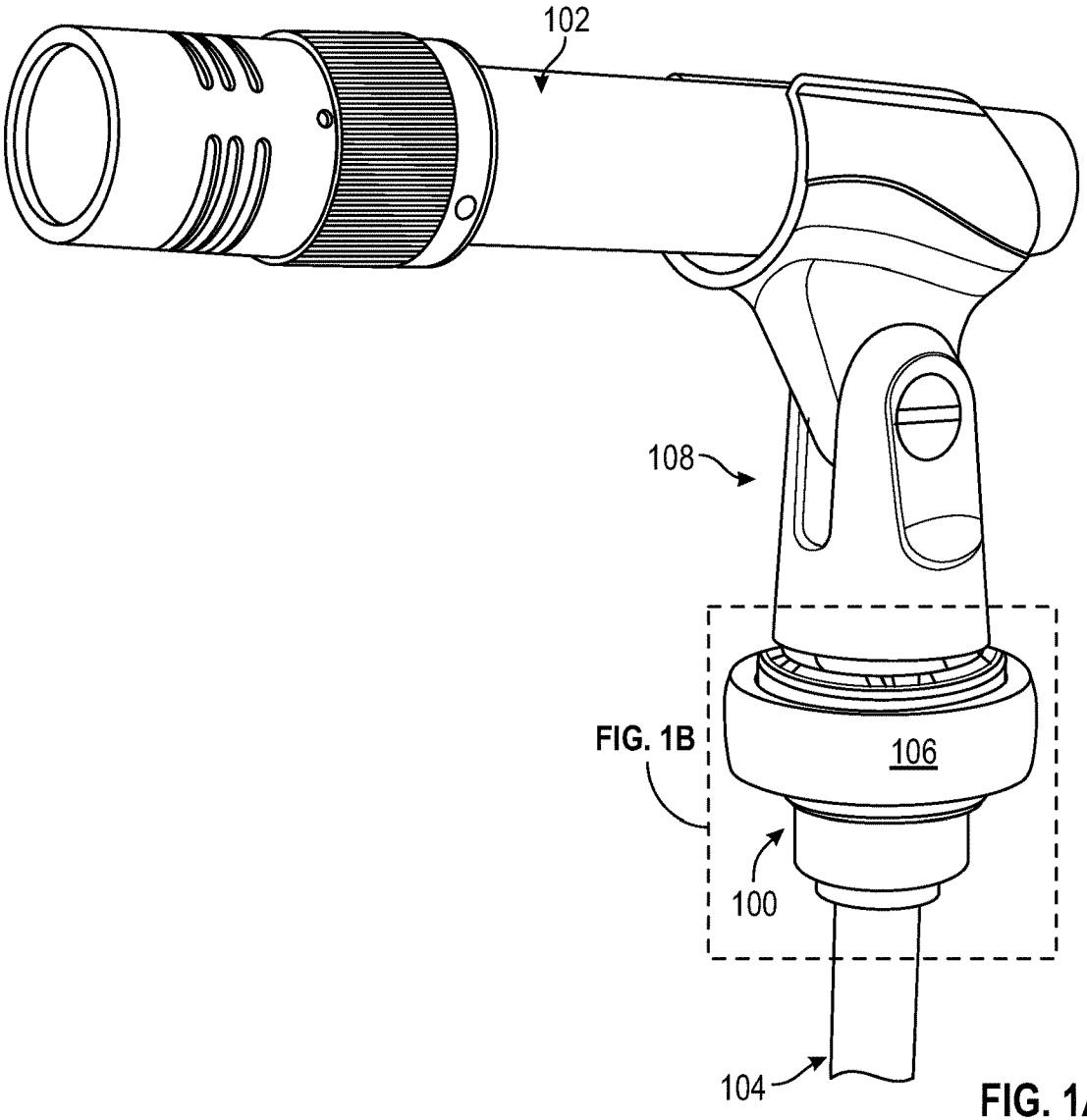
Figure 1C:
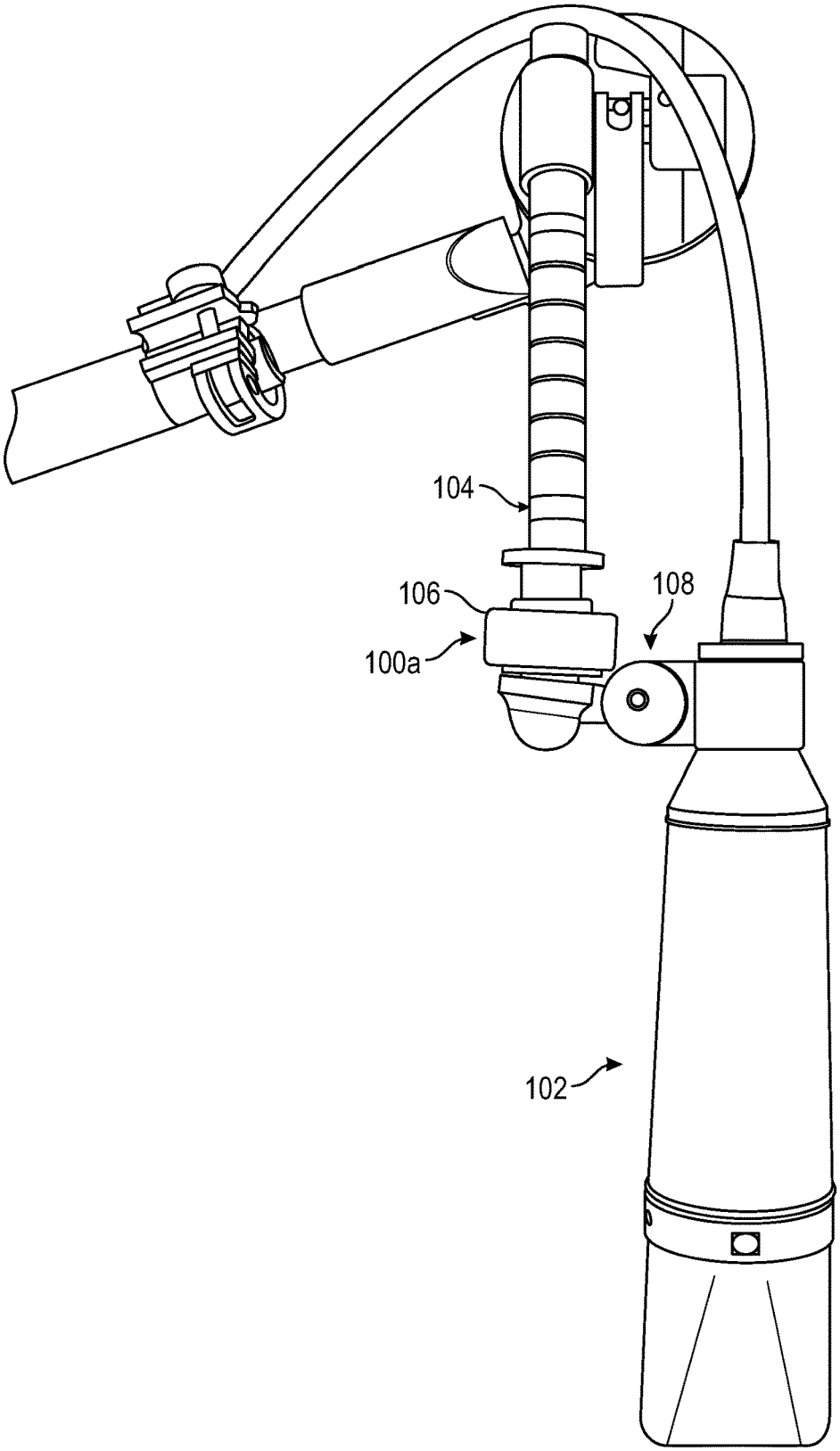
Figure 1D:
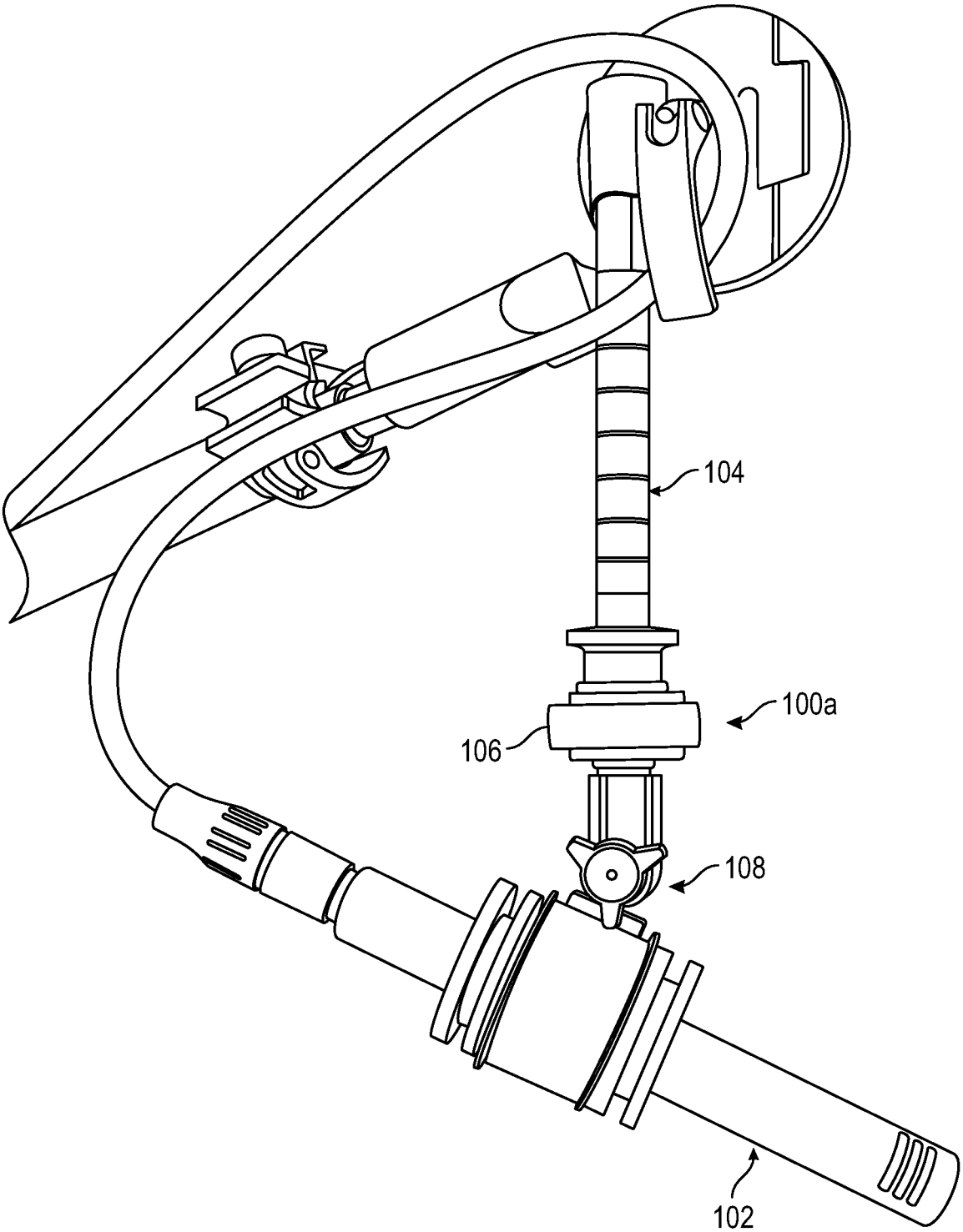
Figure 1E:
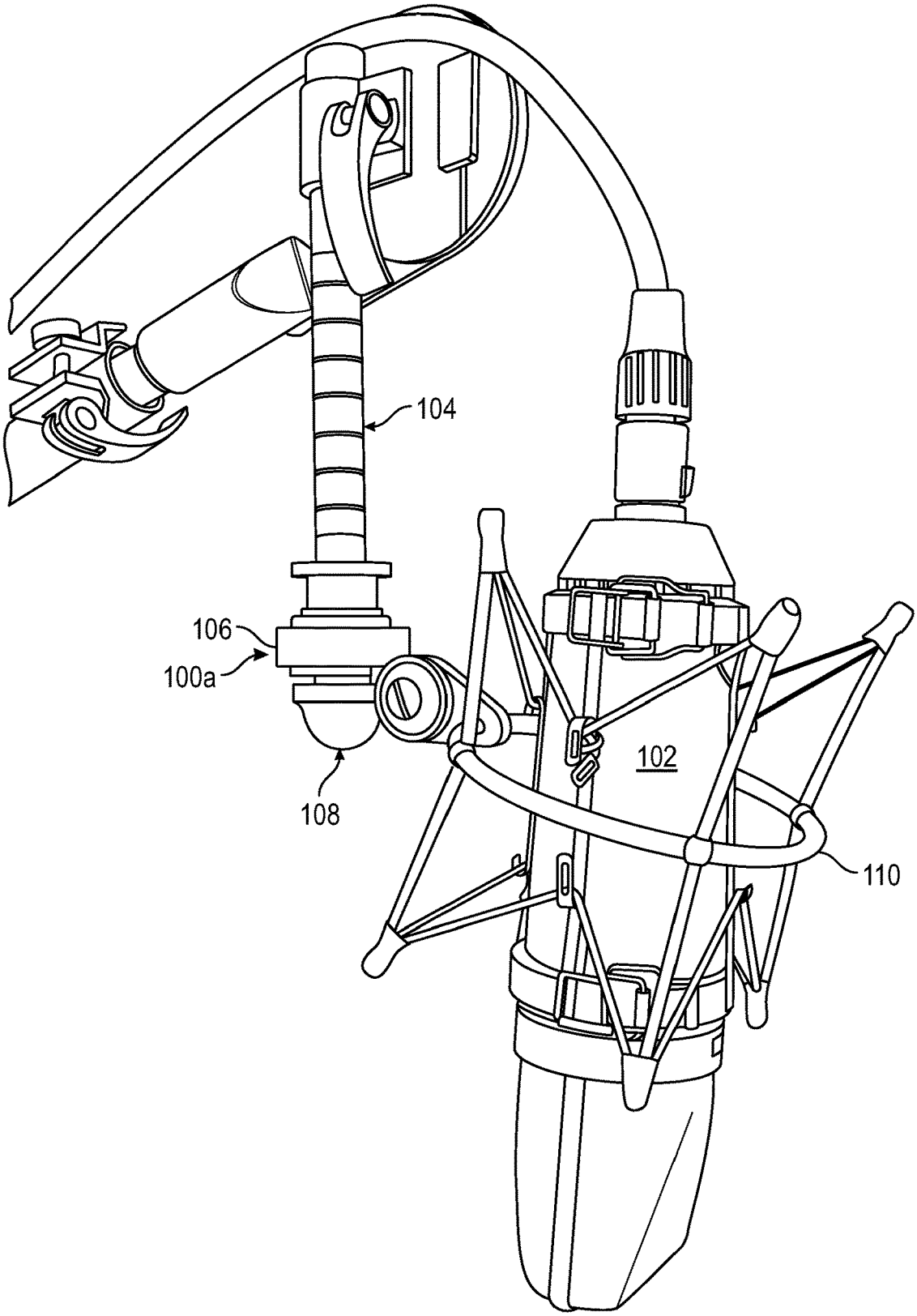

The detailed description set forth below in connection with the appended drawings is intended as a description of presently preferred embodiments of the invention and is not intended to represent the only forms in which the present invention may be constructed and or utilized.

It is to be appreciated that certain features of the invention, which are, for clarity, described in the context of separate embodiments, may also be provided in combination in a single embodiment. Conversely, various features of the invention that are, for brevity, described in the context of a single embodiment may also be provided separately or in any suitable sub-combination or as suitable in any other described embodiment of the invention. Stated otherwise, although the invention is described below in terms of various exemplary embodiments and implementations, it should be understood that the various features and aspects described in one or more of the individual embodiments are not limited in their applicability to the particular embodiment with which they are described, but instead can be applied, alone or in various combinations, to one or more of the other embodiments of the invention.

In the description given below and or the corresponding set of drawing figures, when it is necessary to distinguish the various members, elements, sections/portions, components, parts, or any other aspects (functional or otherwise) or features or concepts or operations of a device(s) or method(s) from each other, the description and or the corresponding drawing figures may follow reference numbers with a small alphabet character such as (for example) "universal mechanical isolator 100*a*, 100*b*, etc." If the description is common to all of the various members, elements, sections/portions, components, parts, or any other aspects (functional or otherwise) or features or concepts or operations of a device(s) or method(s) such as (for example) to all universal mechanical isolator 100*a*, 100*b*, etc., then they may simply be referred to with reference number only and with no alphabet character such as (for example) "universal mechanical isolator 100."

One or more embodiments of the present invention provide a universal mechanical isolator for a microphone that absorbs and dampens shock, microphone noise frequency, and vibration. Further, one or more embodiments of the present invention provide a universal mechanical isolator that is simple to manufacture, use, and is low cost. Additionally, one or more embodiments of the present invention provide a universal mechanical isolator that enables the use of heavier weight microphones (e.g., upwards of 50 ounces or more) mounted in any orientation (sideways, upside down, etc.).

FIGS. 1A to 1E are non-limiting, exemplary illustrations of a universal mechanical isolator in use with plethora of well known, different types of supports (e.g., stands), support-adapters (e.g., microphone clips, including additional other conventional vibration absorbing mounts), and vibrations sensitive devices (e.g., microphones) in multiple orientations accordance with one or more embodiments of the present invention. As illustrated, universal mechanical isolator 100 is truly universal in that it may be associated with large number of different types of supports 104 and support adapters 108, including in combination with existing conventional vibration absorbing mounts 110 (shown in FIGS. 1E, 2B, and 2C). As importantly, universal mechanical isolator 100 enables the use of heavier weight microphones (e.g., upwards of 50 ounces or more) mounted in any orientation (sideways, upside down, etc.), best shown in disassembled view in FIG. 2C.

Universal mechanical isolator 100 is an anti-vibration or vibration-dampening device that effectively decouples well known vibration sensitive devices 102 such as the illustrated microphones from well known supports 104 such as a microphone stand to thereby isolate the vibration sensitive device 102 from mechanical vibrations of stand 104. As detailed below, the generated vibration energy from various sources is dissipated within a resilient middle piece 106 of universal mechanical isolator 100. It should be noted that it is only for convenience of example, mere illustration, and for discussion purposes that a few, well known, non-limiting, non-exhaustive examples of different types of known supports 104, known support-adapters 108, and known conventional vibration sensitive devices 102 are shown in use with universal mechanical isolator 100 and hence, the limited number illustrated should not be limiting.

Figure 2A:
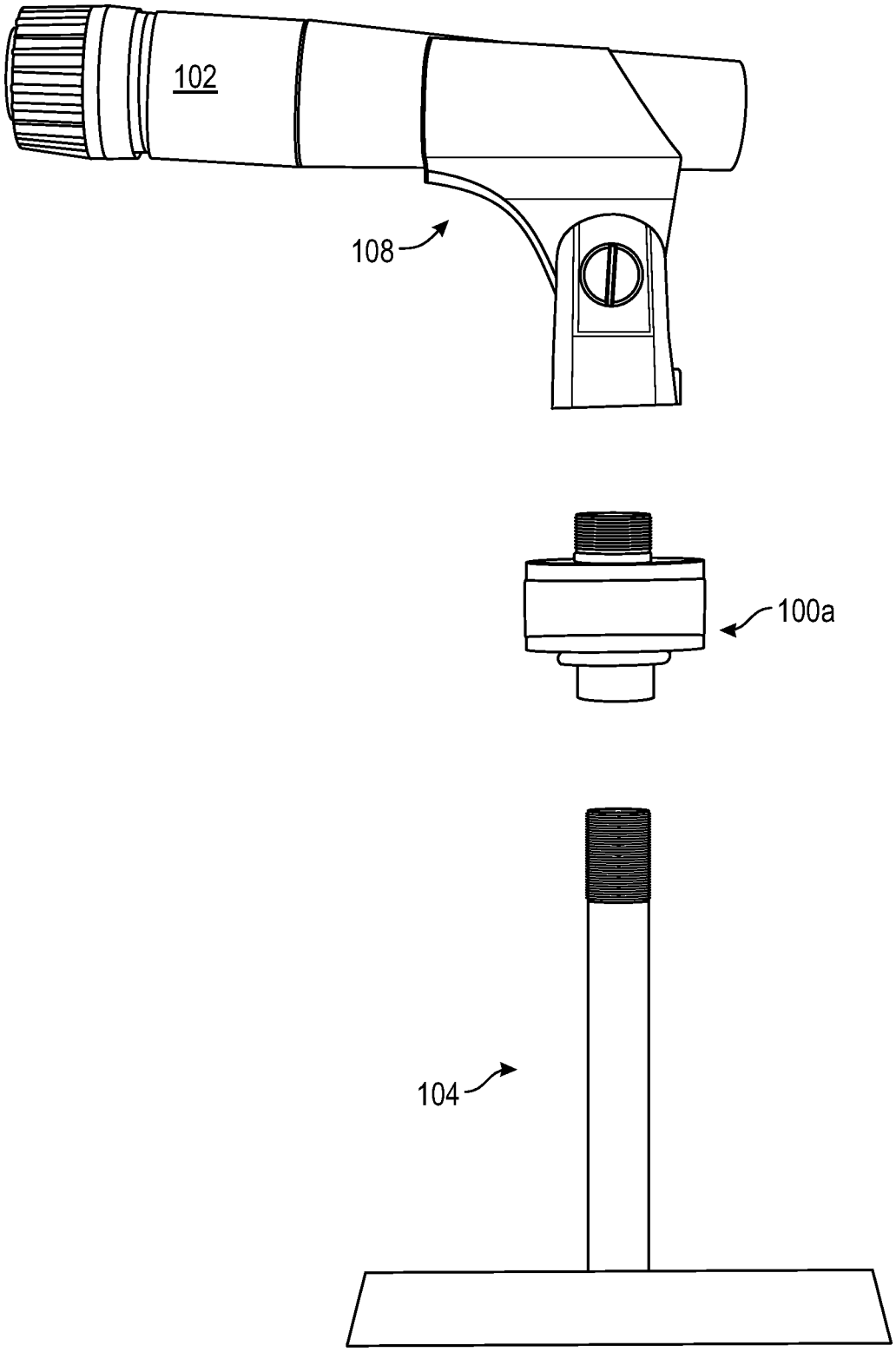
Figure 2B:
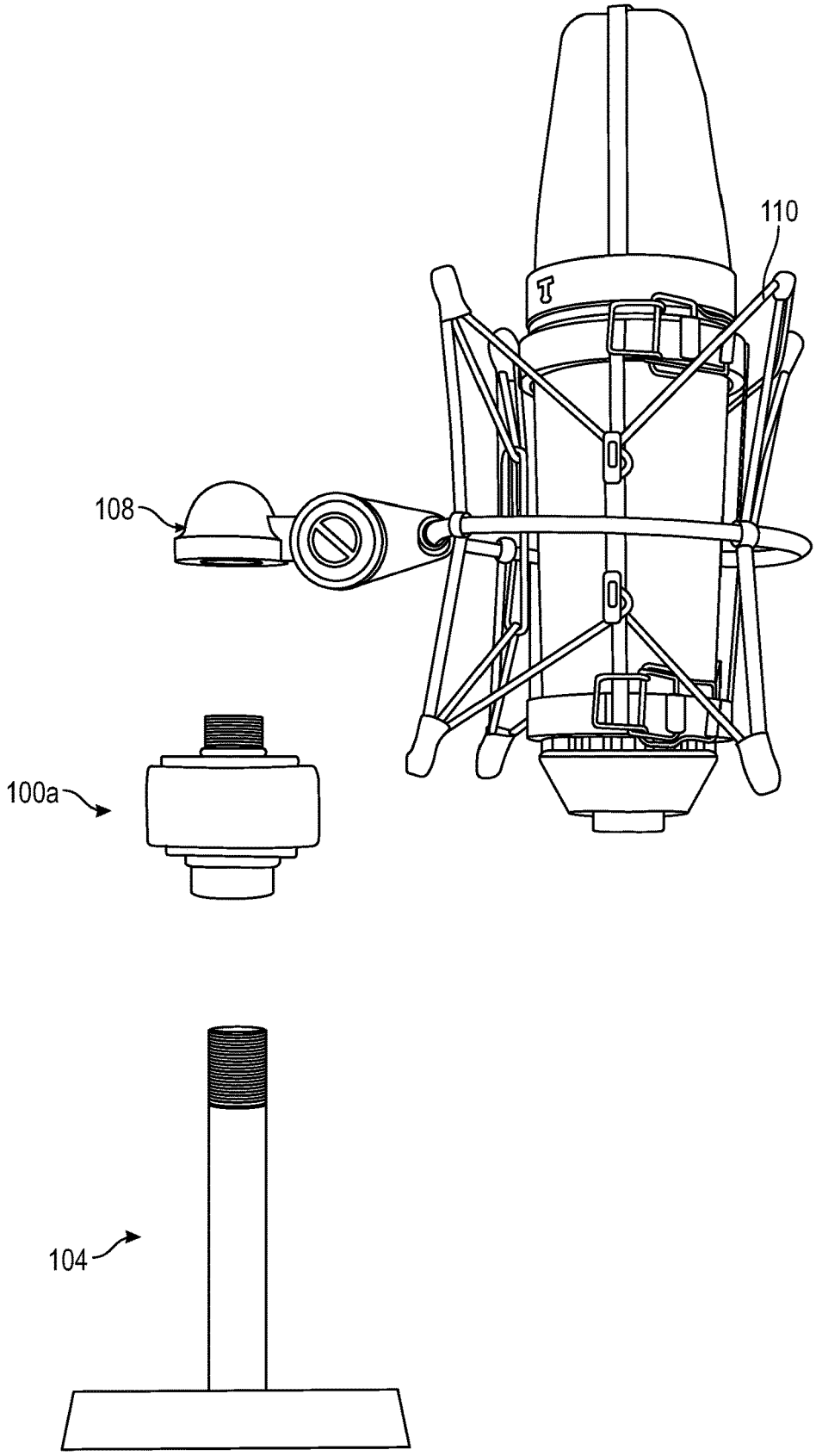
Figure 2C:
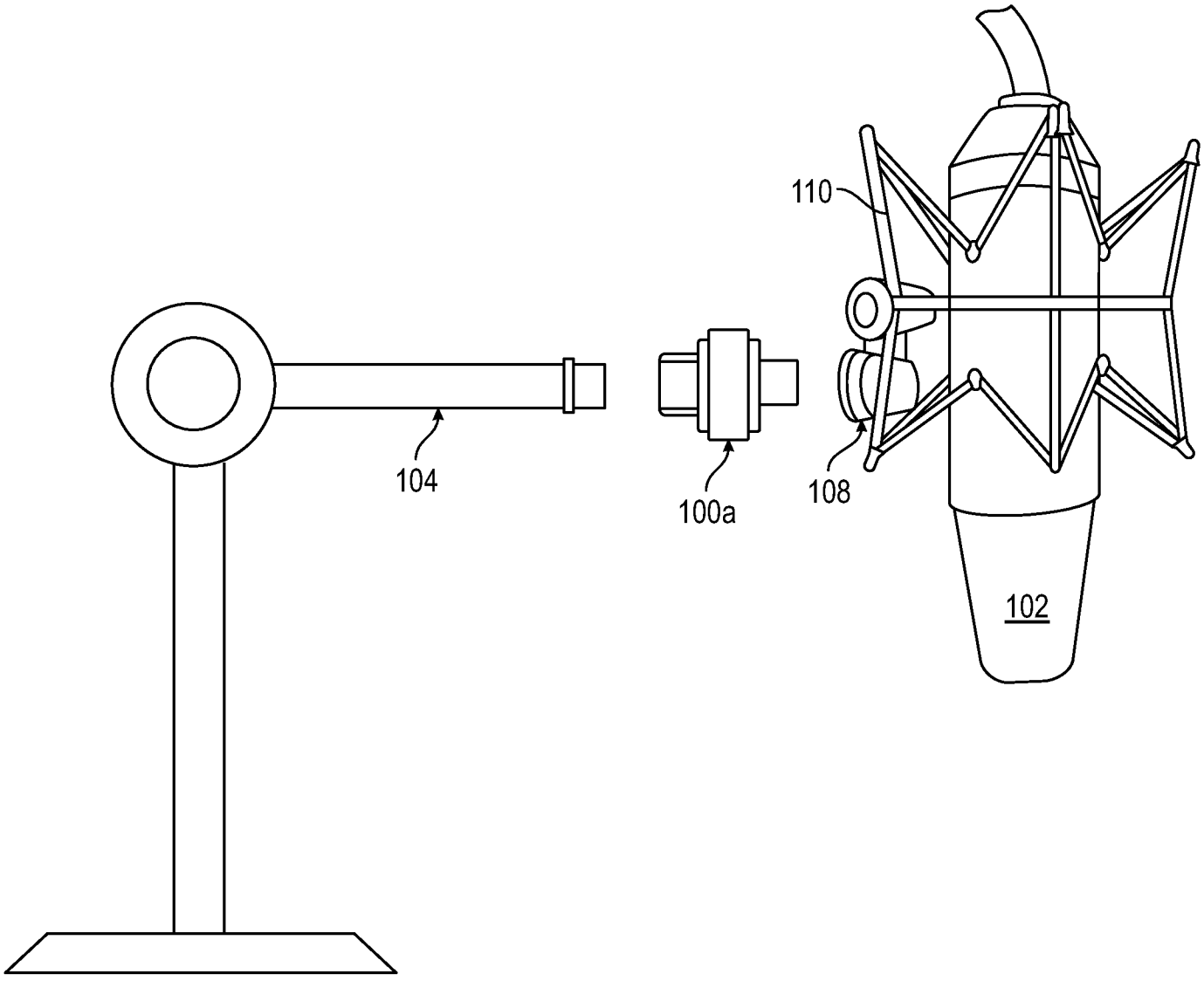

FIGS. 2A to 2C are non-limiting, exemplary exploded view illustrations of the universal mechanical isolator, various different supports, support-adapters, and vibrations sensitive devices in accordance with one or more embodiments of the present invention. The exploded views shown in FIGS. 2A to 2C illustrate disassembled, separated components (e.g., universal mechanical isolator 100, support 104, support adapters 108, and vibration sensitive devices 102) that show the cooperative working relationship, orientation, positioning, and exemplary manner of assembly of the various components in accordance with one or more embodiments of the present invention, with universal mechanical isolator 100*a* detailed below. As best illustrated in FIG. 2C, even when assembled sideways between stand 104 and support adapter 108, universal mechanical isolator 100 can securely hold support adapter 108, with microphone 102 and its own conventional vibration absorbing mounts 110 oriented up, down, or sideways.

FIGS. 3A to 3F are non-limiting, exemplary illustrations, progressively illustrating a non-limiting, exemplary method of assembly of a universal mechanical isolator with a support and support adapter (which includes a vibration sensitive device) in accordance with one or more embodiments of the present invention. As illustrated in FIGS. 1A to 3F, universal mechanical isolator 100 is comprised of a first rigid piece 112 associated with vibration sensitive device 102 through support adapter 108, and a second rigid piece 114 associated with support 104. Further included is resilient middle piece 106 that is positioned between and connected to first rigid piece 112 and to second rigid piece 114, with resilient middle piece 106 absorbing and dampening shock, microphone noise frequency, and other mechanical vibrations.

Figure 3A:
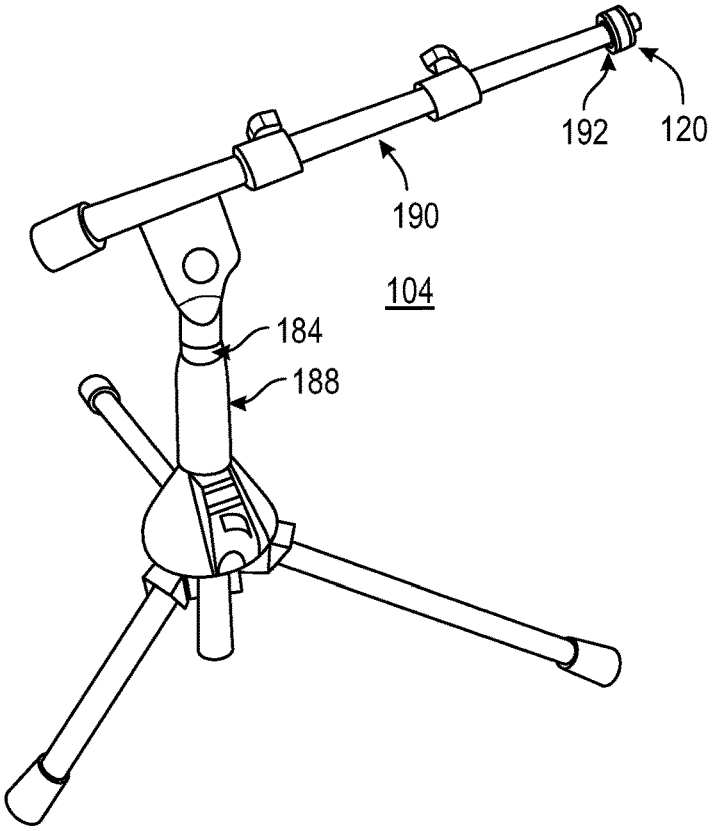
Figure 3B:
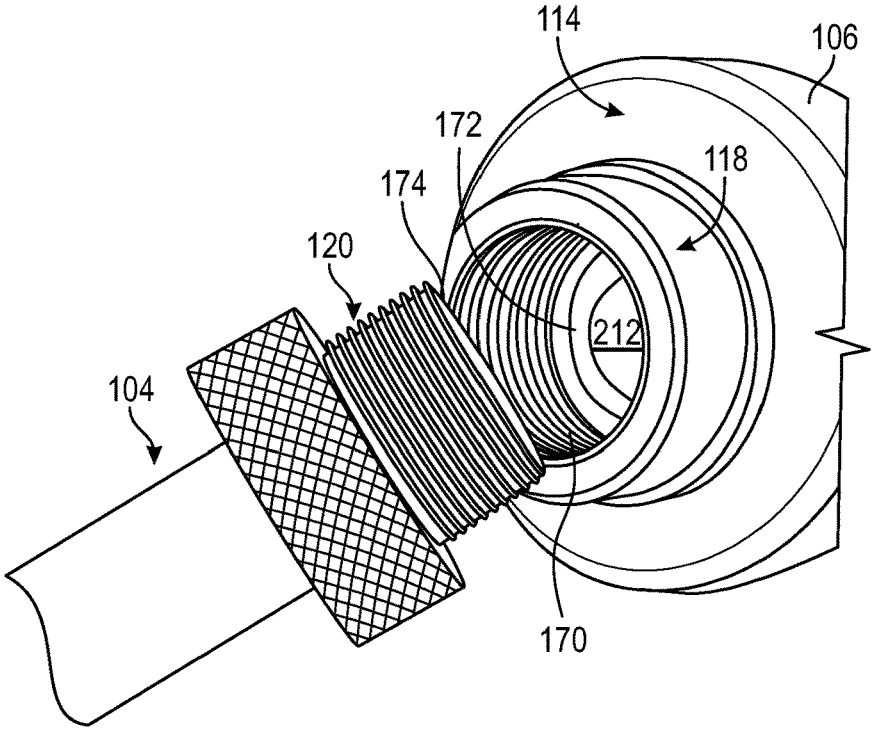

As best illustrated in FIG. 3A, conventional support 104 illustrated may be a tripod that has an upright support 188 and a horizontal "boom" arm 190. The two are connected by threaded connector 184, which is identical to distal end connector 120 at distal end 192 of arm 190. Accordingly, a second mechanical isolator 100 may also be additionally secured between the upright support 188 and horizontal "boom" arm 190 at threaded connector 184.

First rigid piece 112 includes a first mechanical connection 116 (a male threaded member, shown in FIG. 3D) for detachably coupling first rigid piece 112 with support adapter (or microphone clip) 108 that has female threaded connector 122. Vibration sensitive device (microphone) 102 is detachably mounted on support adapter 108 in a conventional manner. As further illustrated, second rigid piece 114 (FIG. 3B) includes a second mechanical connection 118 (female thread) for detachably coupling with support 104 that has male threaded connector 120.

Figure 3C:
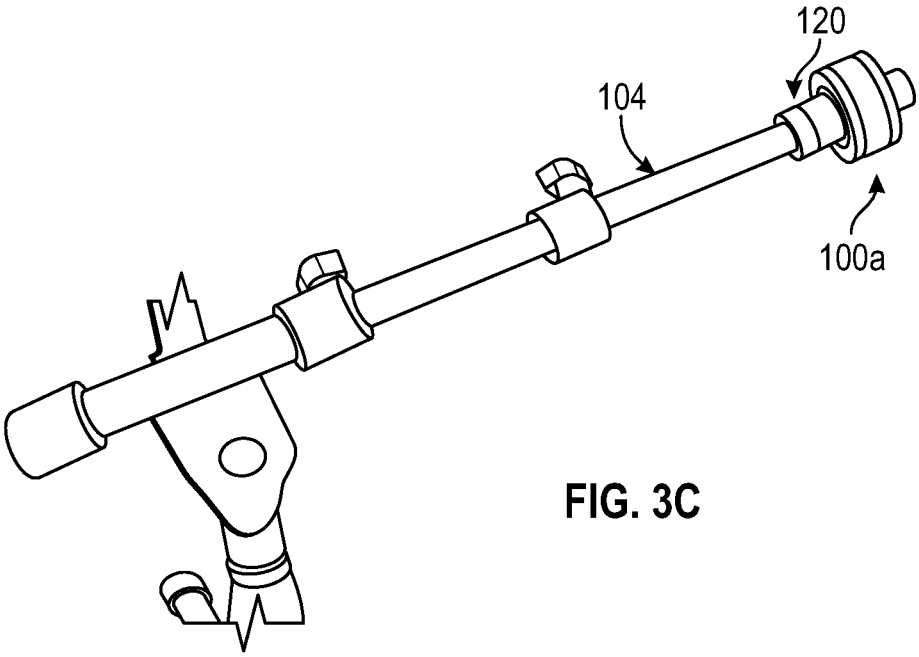
Figure 3D:
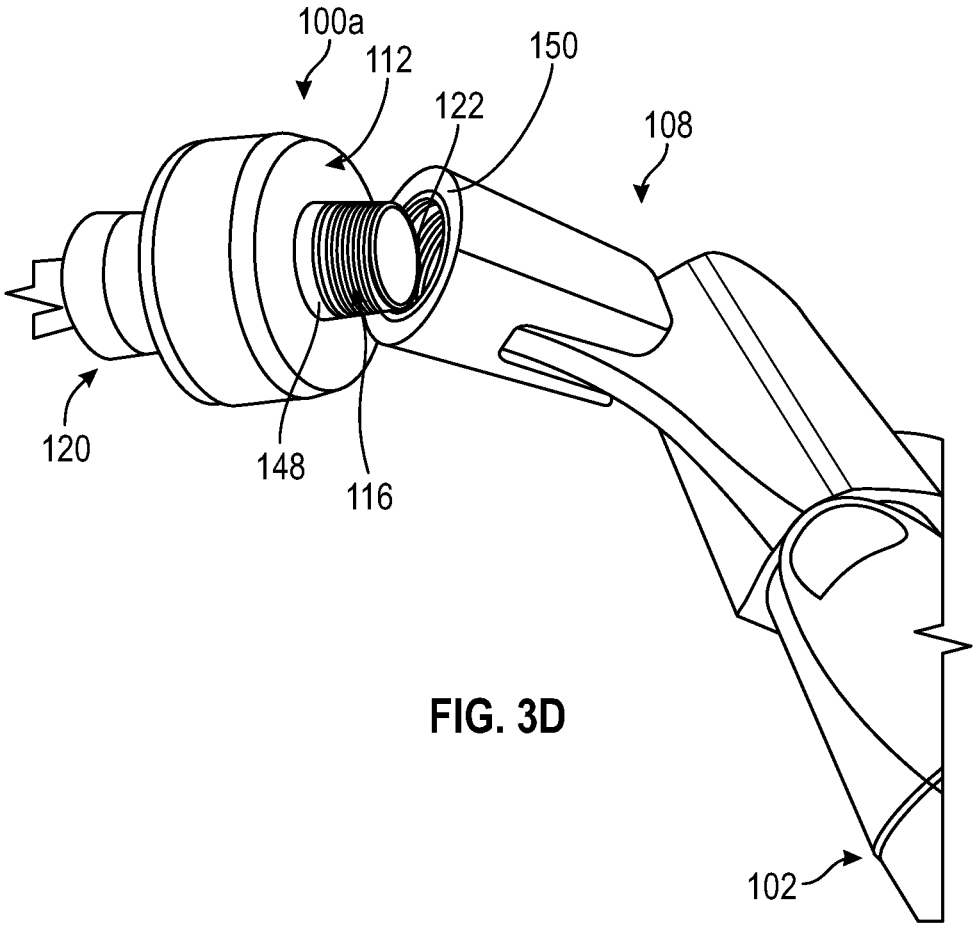
Figure 3E:
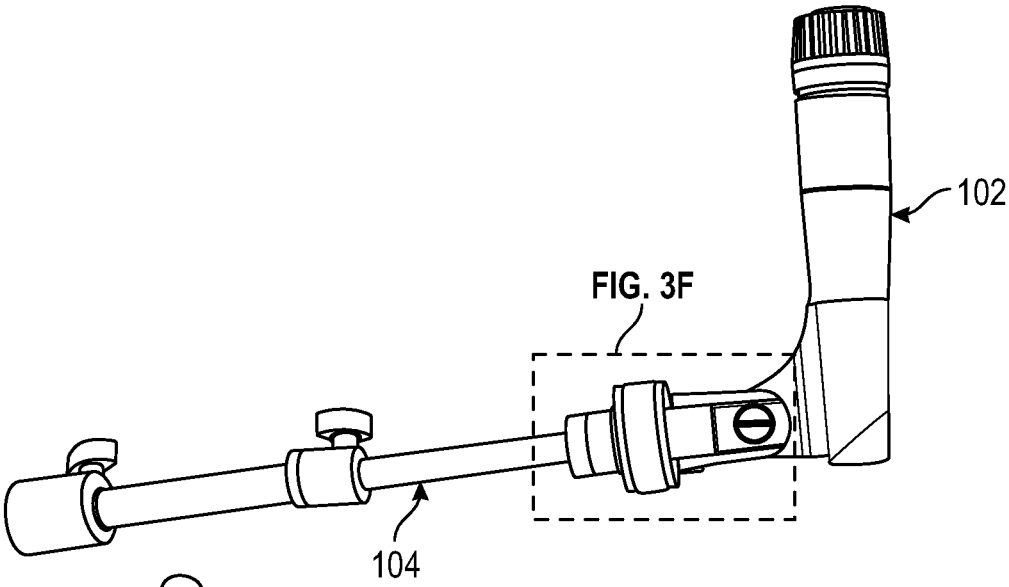
Figure 3E:
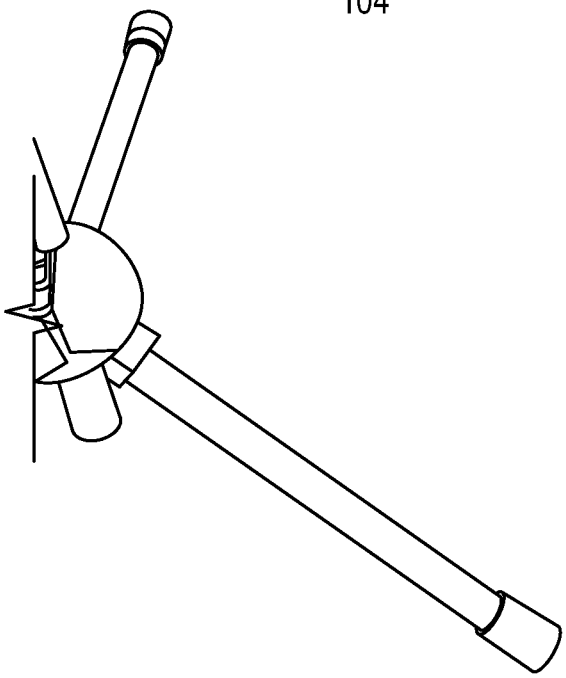
Figure 3F:
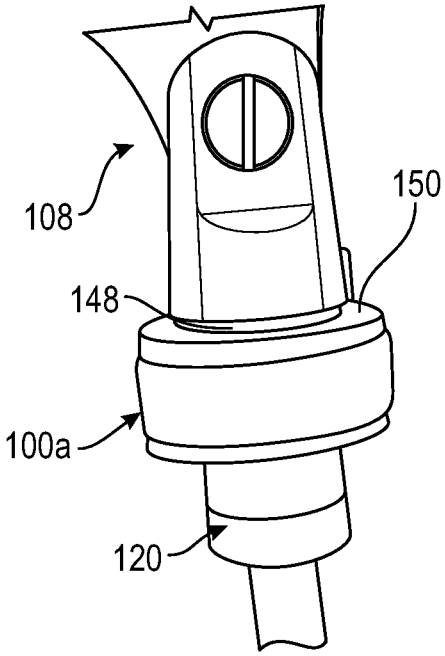

In the non-limiting, exemplary instance shown in FIGS. 1A to 3F, second mechanical connection 118 has female threading 170 that fastens onto a male threaded connector 120 of support 104 and as illustrated in FIGS. 3C and 3D, first mechanical connection 116 is male threaded that fastens onto a female threaded connector 122 of support adapter 108, resulting in full assembly as shown in FIGS. 3E and 3F. It should be noted that the order of connecting support 104, universal mechanical isolator 100, and support adapter 108 may obviously be varied. For example, universal mechanical isolator 100 may first be fastened to support adapter 108, and the combination of both fastened to support 104.

FIGS. 4A to 4D are non-limiting, exemplary illustrations of the various views of the fully universal mechanical isolator illustrated in FIGS. 1A to 3F in accordance with one or more embodiments of the present invention. As illustrated in FIGS. 1A to 4D, universal mechanical isolator 100 includes first rigid piece 112, second rigid piece 114, and resilient middle piece 106. It should be noted that first rigid piece 112, second rigid piece 114, and resilient middle piece 106 may vary in terms of material (e.g., rigid plastic verses metal such as steel or alloys thereof), size, etc.

Figure 8A:
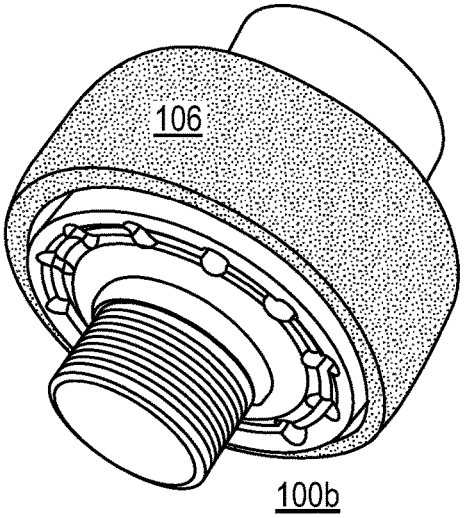
FIGS. 8A to 8D are non-limiting, exemplary illustration of a universal mechanical isolator in accordance with one or more embodiments of the present invention
Figure 8B:
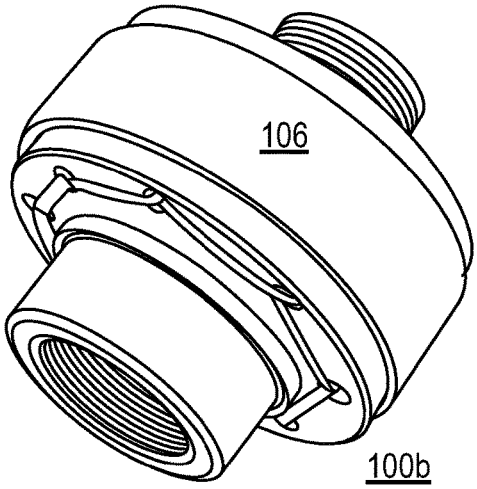
Figure 8C:
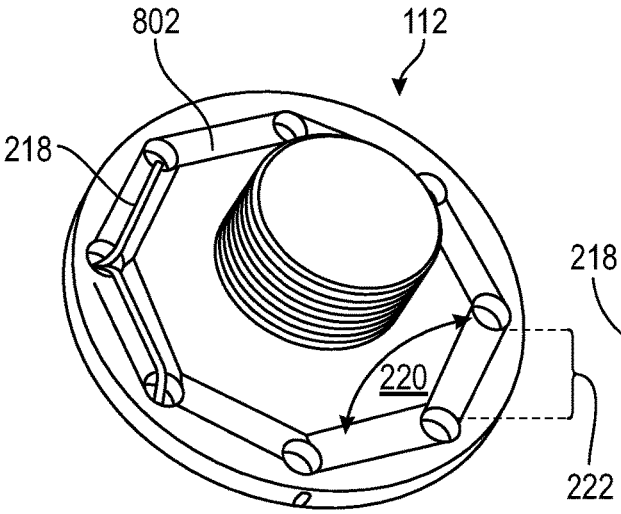
Figure 8D:
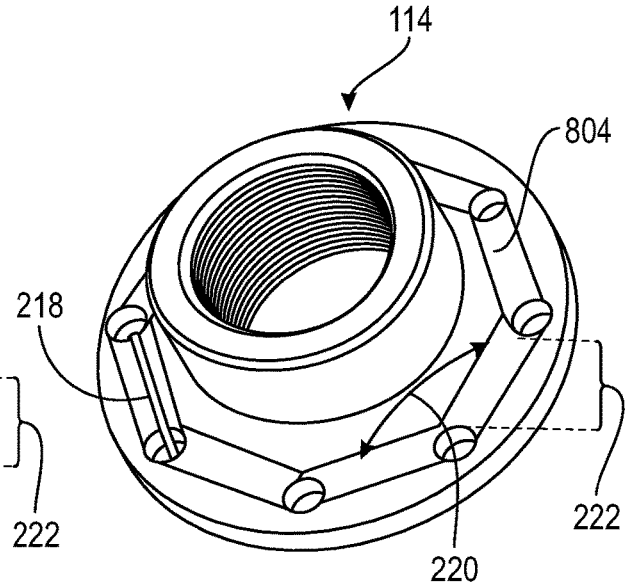

In general, resilient middle piece 106 is a flexible piece to disburse vibration within itself. Resilient middle piece 106 may comprise of known resilient material non-limiting examples of which may include felt (e.g., well known industrial felt material, shown in FIGS. 1C, 6A, and 8A), rubber (including synthetic rubber), ethylene propylene diene monomer (EPDM) with various degrees of hardness rating (or scales), etc. A non-limiting, specific example of material that may comprise resilient piece 106 may include rubber from SORBOTHANE, INC., which may include "visco-elastic polymer" and a "super soft polyurethane" with different durometer scales (or ratings or measures of hardness).

The specific durometer used for the material of resilient piece 106 depends on many factors such as the weight, position, and orientation of the connection of the universal mechanical isolator in relation to the support and support adapter, including vibrations sensitive device. For example, for lightweight, small microphones (4 or 5 ounces) with a lightweight support, etc., a resilient piece 106 with softer material may be used.

As indicated above, first rigid piece 112 includes first mechanical connection 116, while second rigid piece 114 includes second mechanical connection 118. First rigid piece 112, second rigid piece 114, and resilient middle piece 106 may be any size with first and second mechanical connections 116 and 118 commensurate in terms of design and size with corresponding connection mechanisms of support 104 and adapter support 108. Therefore, the use of male/female threading as mechanical connections for universal mechanical isolator 100 may be varied to correspond to the mechanical connection scheme and requirements of support and support adapter and hence, should not be limiting. For example, if a support uses a "snap" connection scheme, second mechanical connection 118 of second rigid piece 114 may be modified to "snap" onto support rather than be fastened onto support 104 using the illustrated threads. Further, the sizes of first rigid piece 112, second rigid piece 114, and resilient middle piece 106 may be varied independent of variations in the mechanical connection schemes 116 and or 118 used.

Figure 4A:
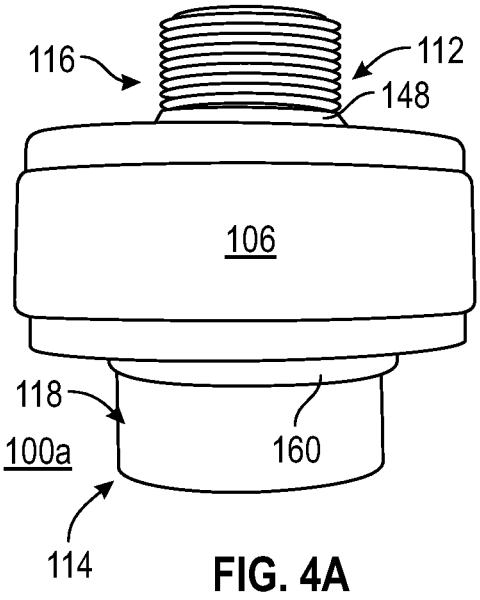
Figure 4B:
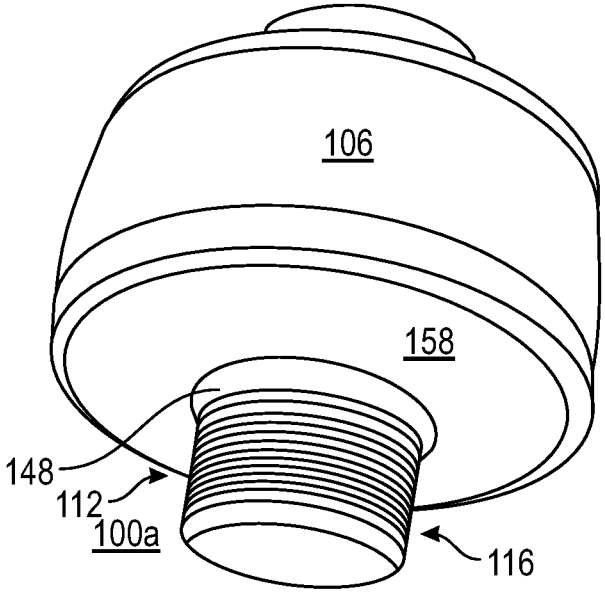
Figure 4C:
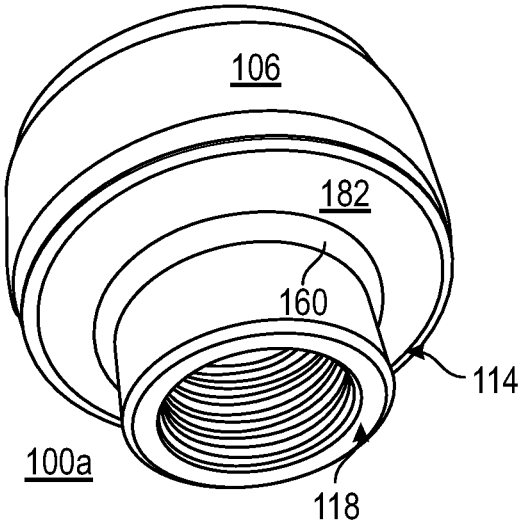
Figure 4D:
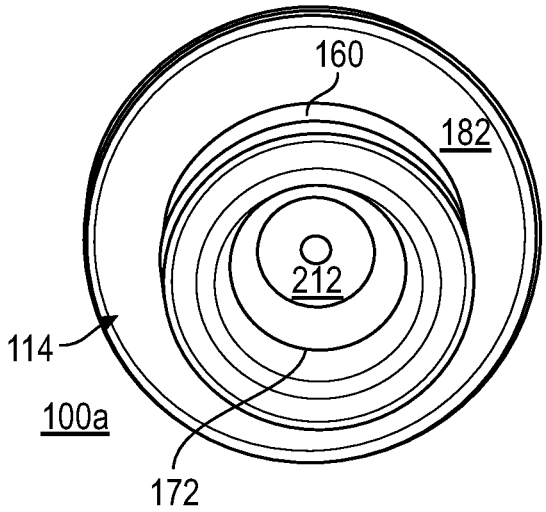
Figure 5A:
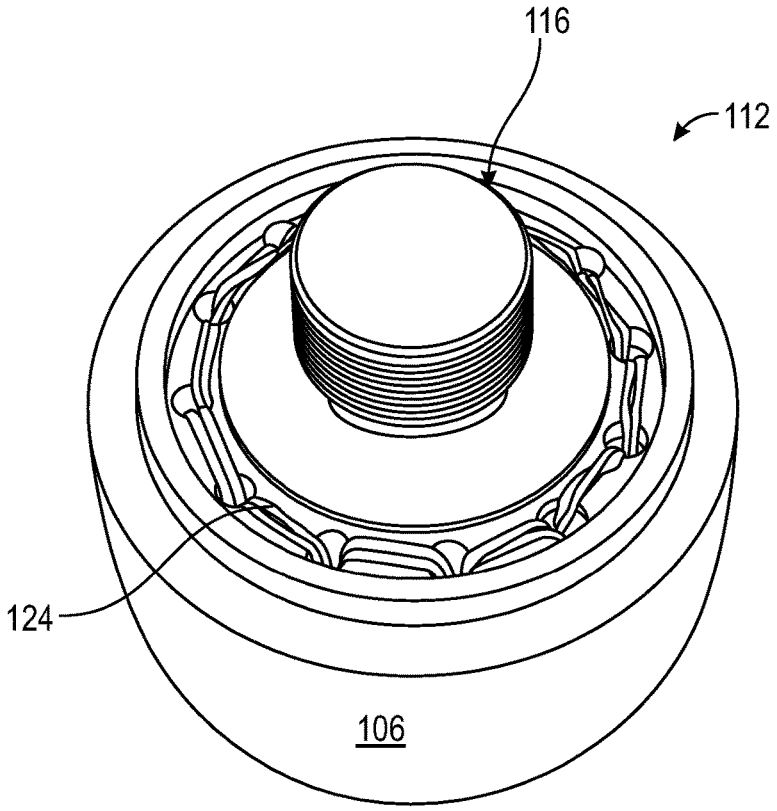
Figure 5B:
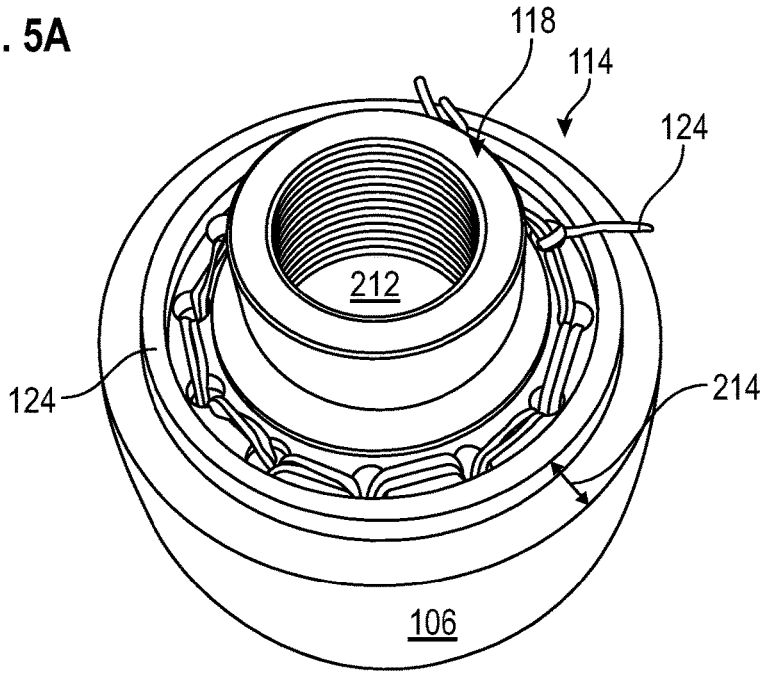
Figure 5C:
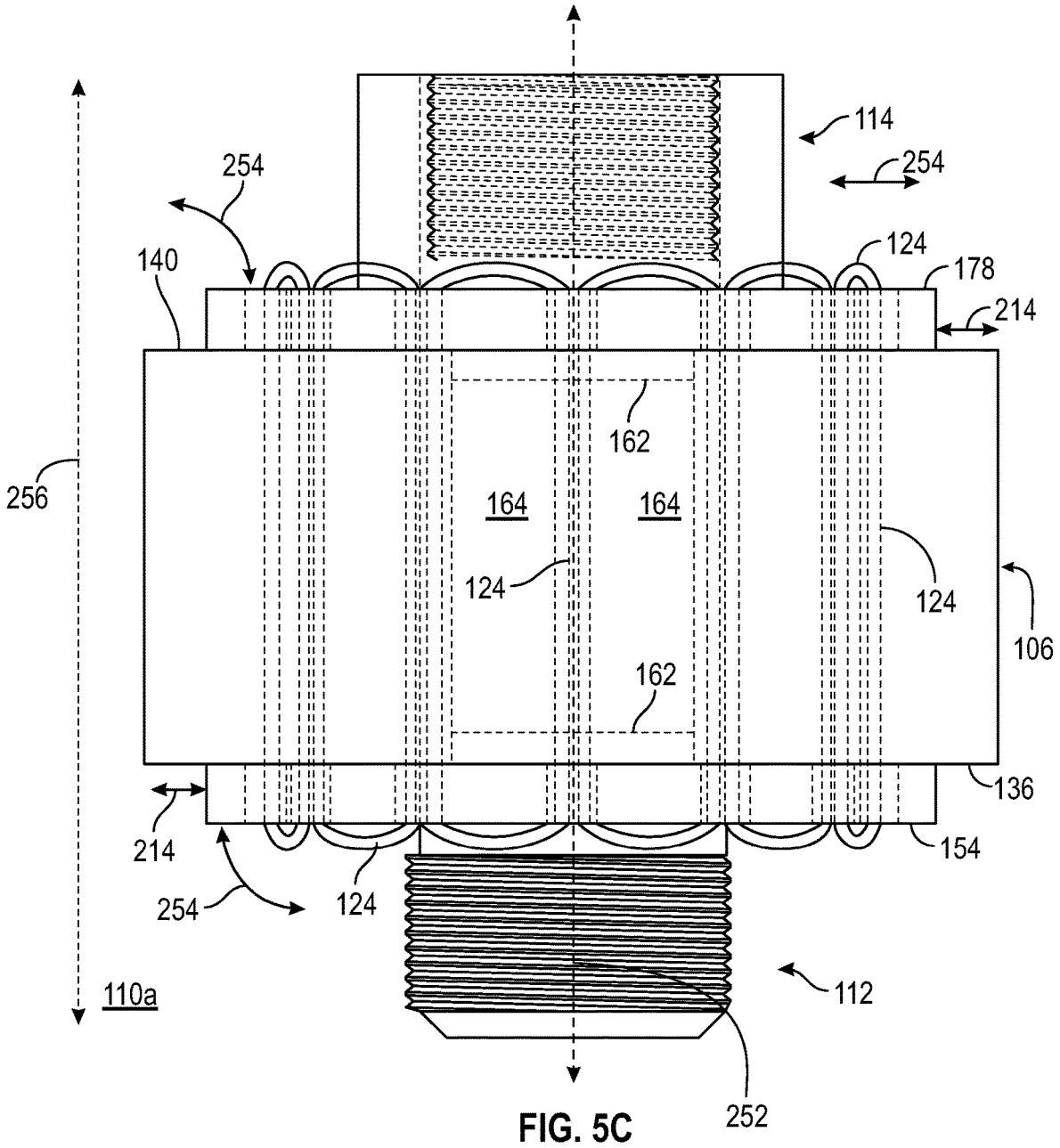

FIGS. 5A to 5C are non-limiting, exemplary illustrations of the universal mechanical isolator illustrated in FIGS. 1A to 4D, but with covers removed to expose threaded stitching in accordance with one or more embodiments of the present invention. As further detailed below and shown in FIGS. 1A to 5C, resilient middle piece 106 is mechanically connected and fixed to first and second rigid pieces 112 and 114 by a thread 124, which is comprised of a long, thin strand of fibers with high tensile strength. That is, first and second rigid pieces 112 and 114 are literally stitched and sewed to resilient middle piece 106 by thread 124. Use of thread 124 to securely mount first and second rigid pieces 112 and 114 onto resilient middle piece 106 is that thread 124 would not transmit vibrations.

It should be noted that universal mechanical isolator 100 does not have any rigid piece contacting any another rigid piece. In other words, there are no adjacent rigid pieces that directly contact one another. First and the second rigid pieces 112 and 114 connect to non-rigid, resilient member 106 (with a durometer value that may range from about 30 to 75) using a flexible thread 124 (for example, of Kevlar material with tensile strength of about 23 pounds). Therefore, the scheme of universal mechanical isolator 100 is to add to its overall dampening capability.

It should further be noted that in FIG. 5C, it is only for discussion purposes that threads 124 near first rigid piece 112 and second rigid piece 114 are illustrated as being above respective periphery edge 154 and 178 of first and second rigid pieces. Thread 124 is shown as such to illustrate a complete, continuous stitching loop of the sewn thread 124 from first rigid piece 112, through resilient middle piece 106, to second rigid piece 114, and back to first rigid piece 112 via resilient middle piece 106. As shown in all other figures however, thread 124 is actually stitched tightly against bases 142 and 166 of first and second rigid pieces 112 and 114 to securely fix first and second rigid pieces 112 and 114 to resilient middle piece 106.

Figure 6A:
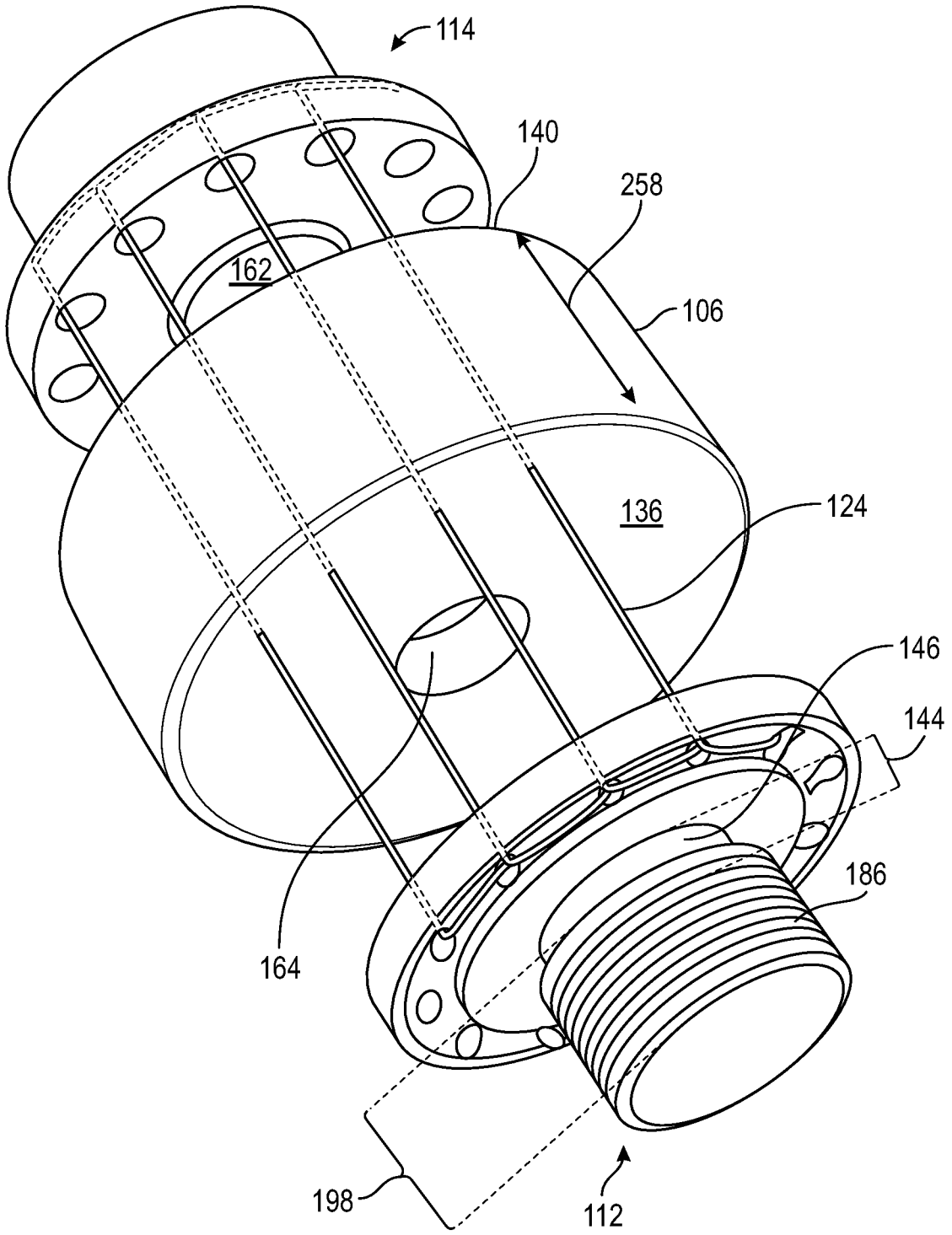
Figure 6B:
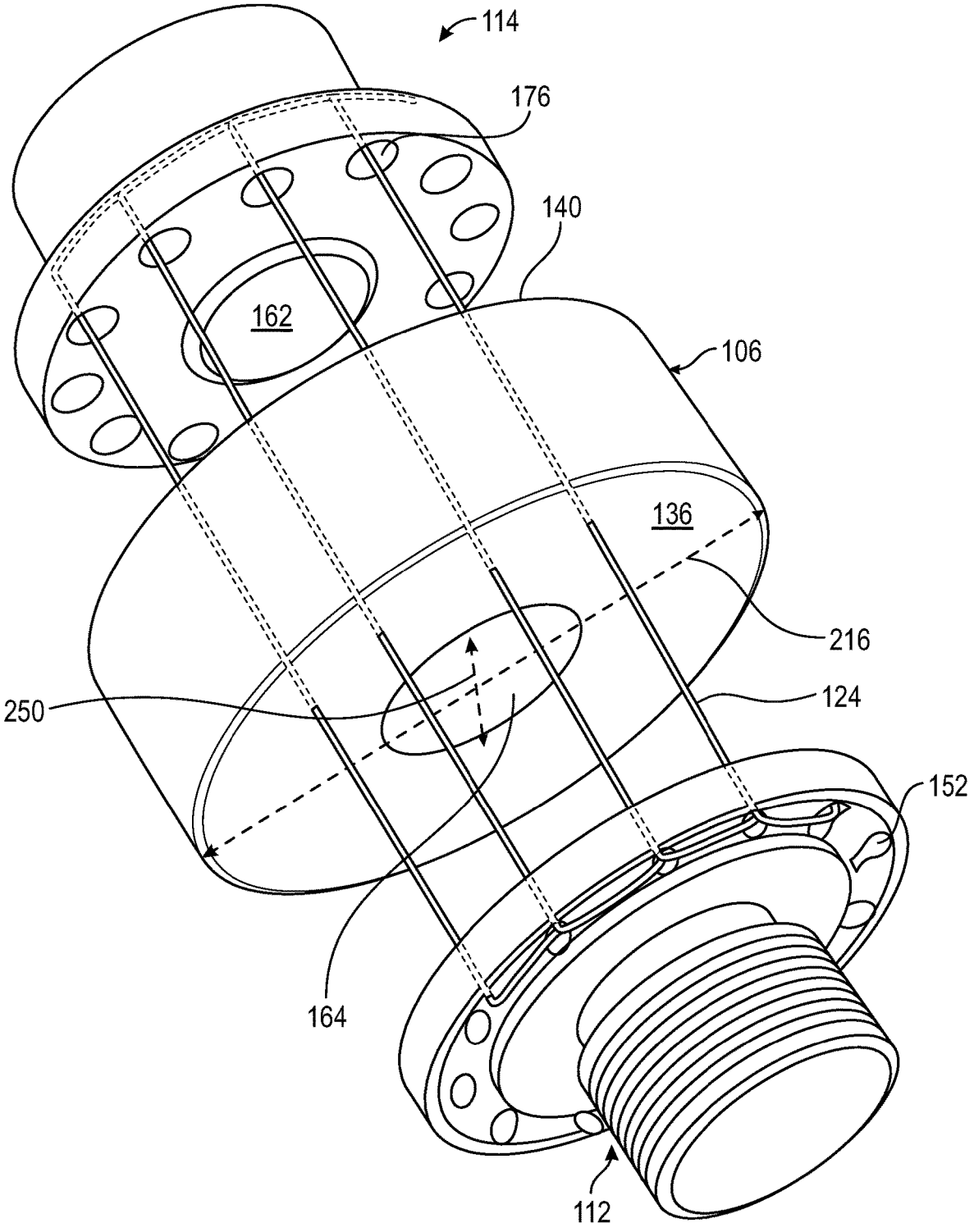
Figure 6C:
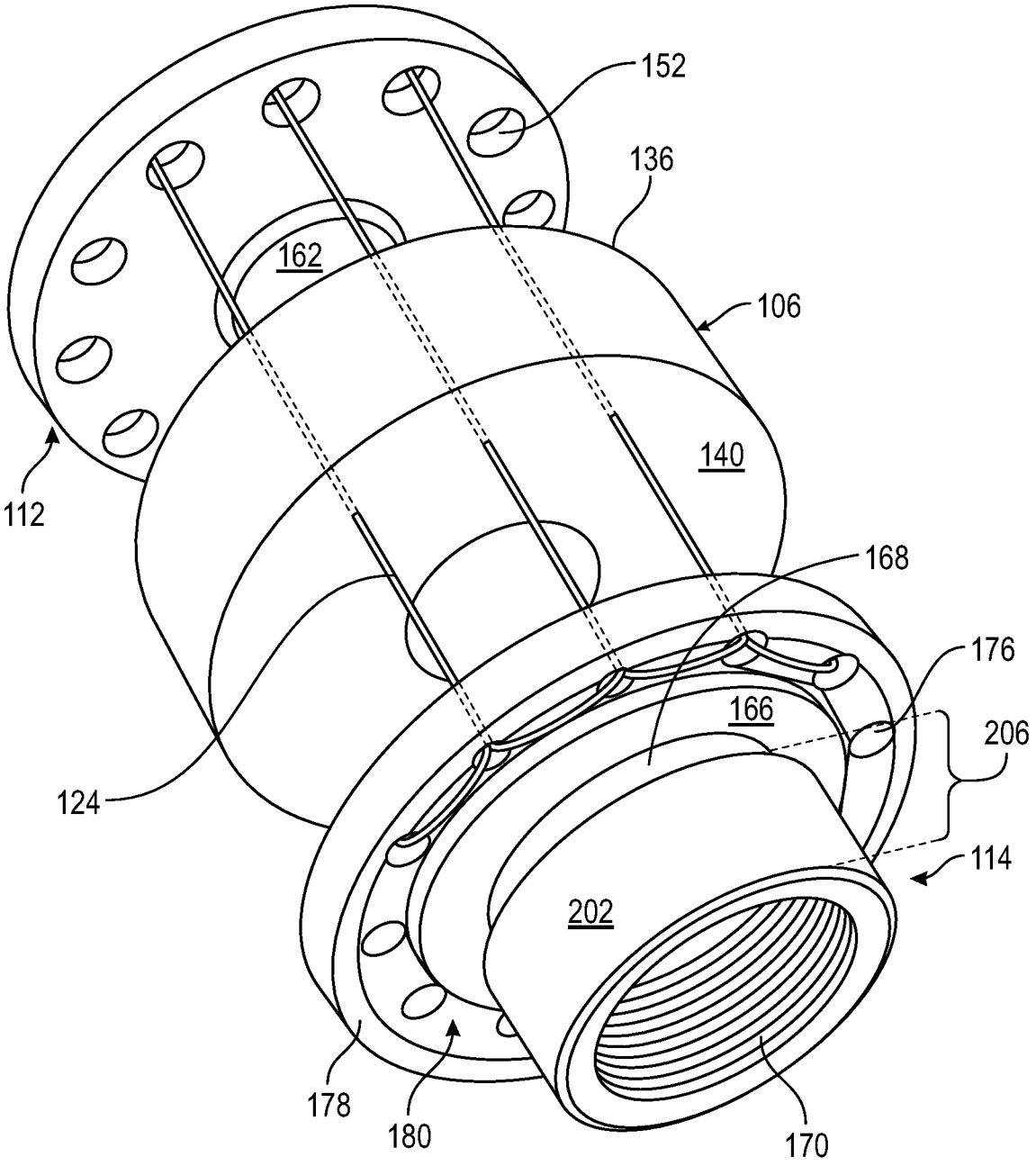
Figure 6D:
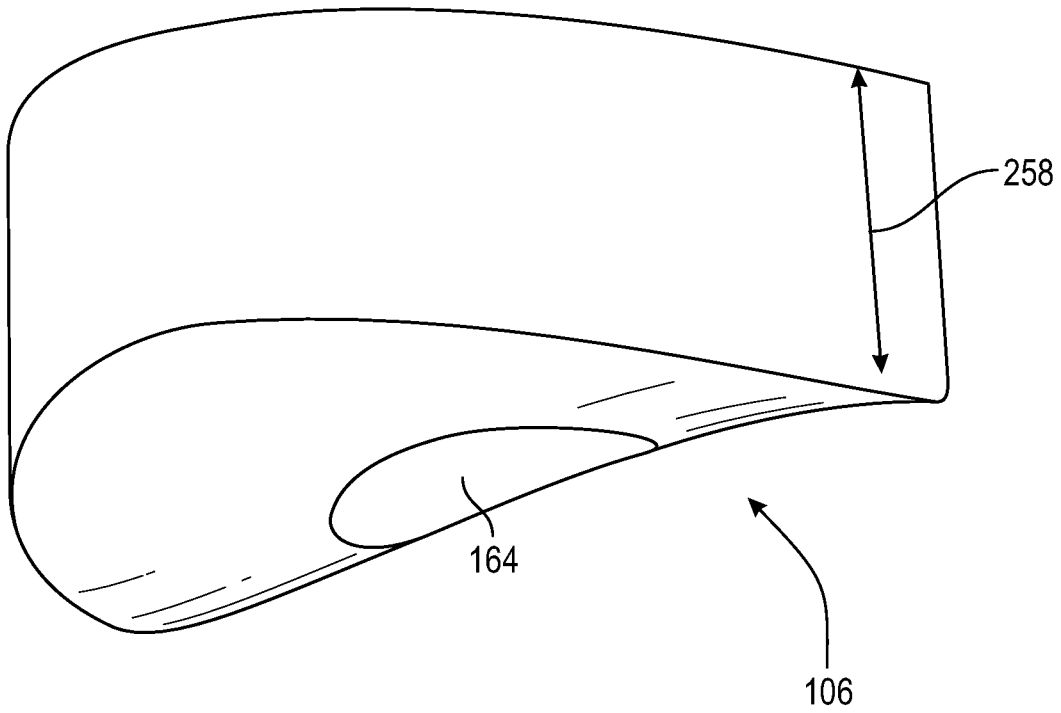

FIGS. 6A to 6C are non-limiting, exemplary exploded view illustrations of the universal mechanical isolator in accordance with one or more embodiments of the present invention (but without showing o-rings). The exploded views shown in FIGS. 6A to 6C illustrate disassembled, separated components that show the cooperative working relationship, orientation, positioning, and exemplary manner of assembly of the various components of universal mechanical isolator 100 in accordance with one or more embodiments of the present invention, with first and second rigid pieces 112 and 114 detailed further in relation to FIGS. 7A to 7D. FIG. 6D is a non-limiting, exemplary illustration of a resilient middle piece only, shown in flexed position in accordance with one or more embodiments of present invention.

Figure 7A:
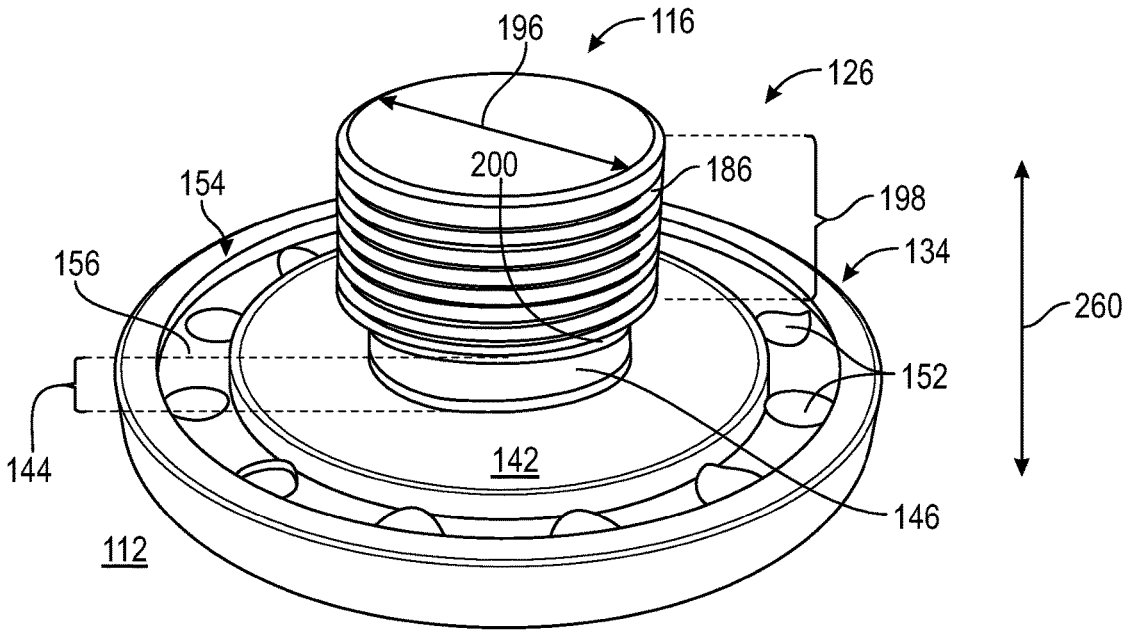
Figure 7B:
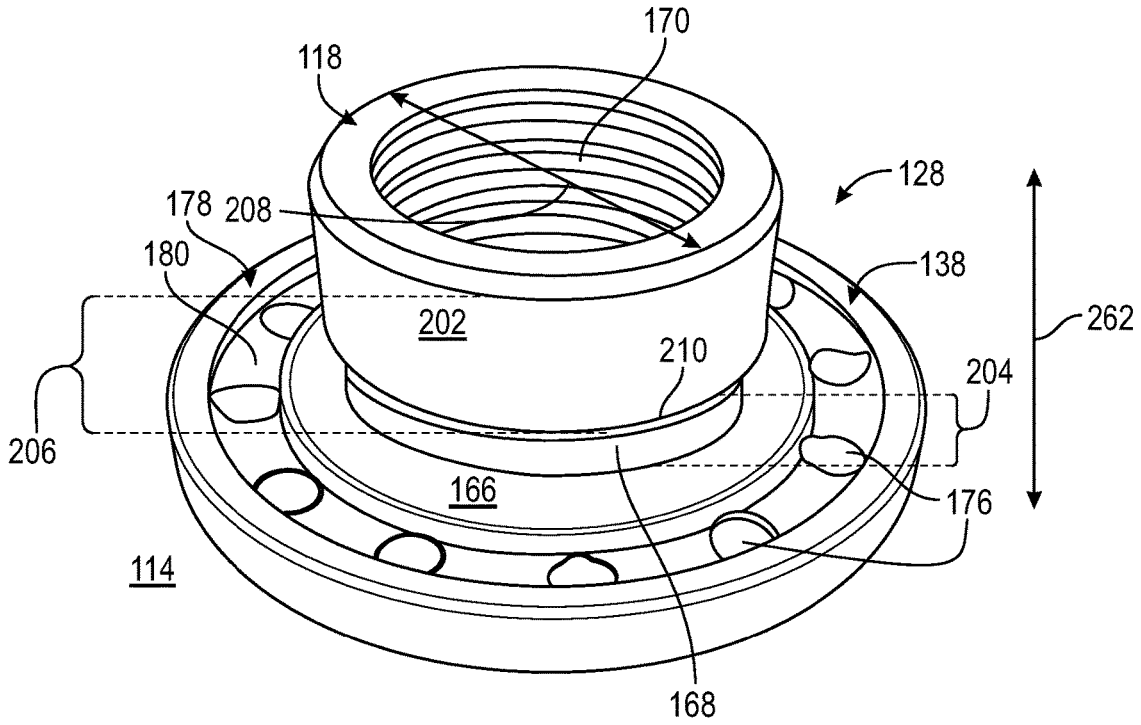

FIGS. 7A to 7D are non-limiting, exemplary illustrations of the various views of the first and second rigid pieces in accordance with one or more embodiments of the present invention. FIG. 7A is non-limiting, exemplary illustration of a first side 126 of first rigid piece 112 and FIG. 7B is non-limiting, exemplary illustration of a first side 128 of second rigid piece 114.

Figure 7C:
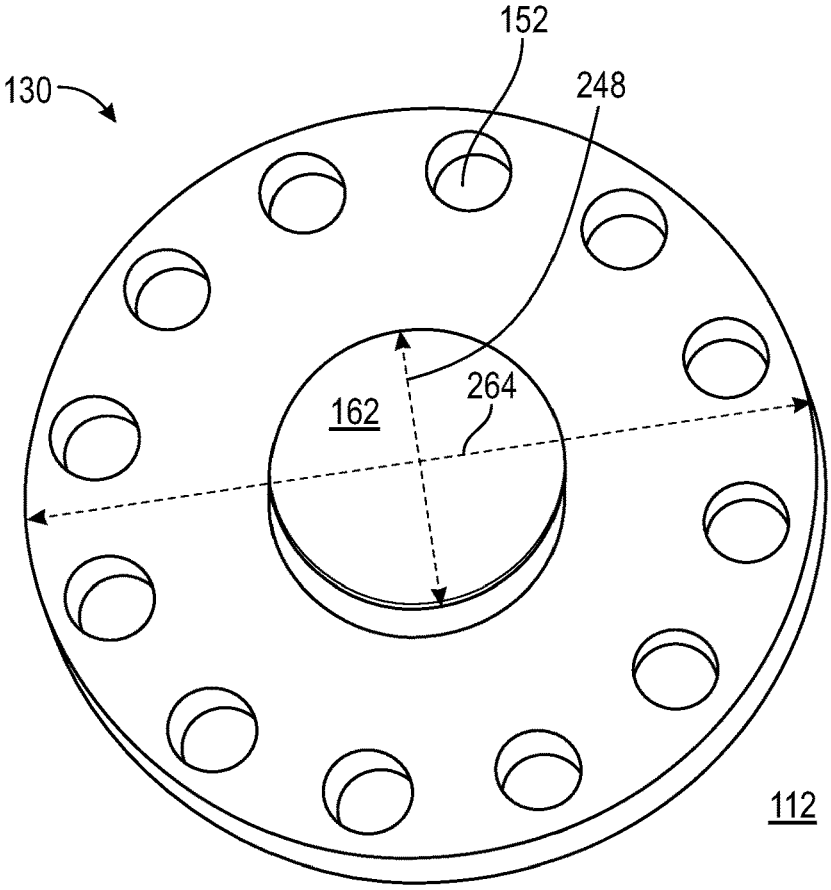
Figure 7D:
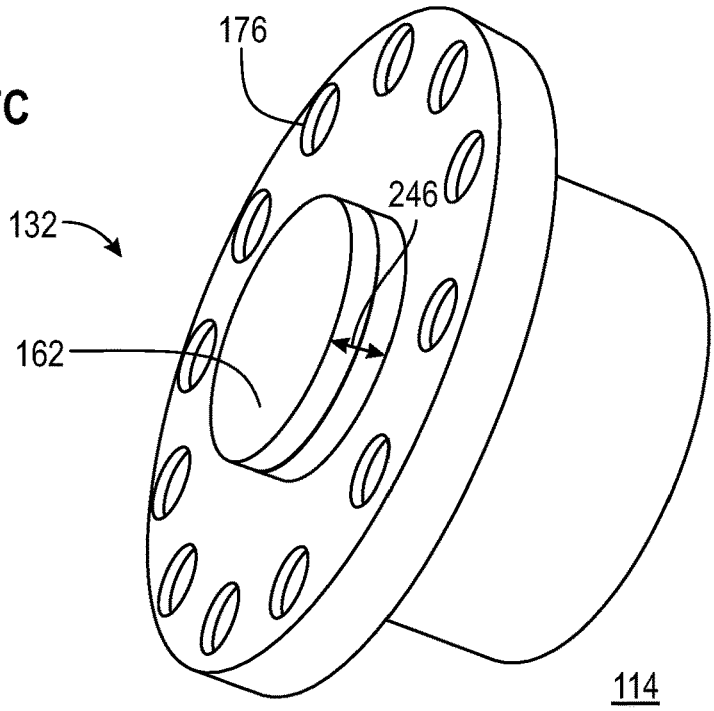

FIGS. 7C and 7D are non-limiting, exemplary illustrations of the various views of second sides 130 and 132 of first rigid piece 112 and second rigid piece 114. As illustrated in FIGS. 7C and 7D, topography of second sides 130 and 132 of first rigid piece 112 and second rigid piece 114 are identical in every aspect, with FIG. 7C illustrating second side 130 of first rigid piece 112 and 7D illustrating second side 132 of second rigid piece 114, with both second sides 130 and 132 of the first and second rigid piece 112 and 114 being identical.

As illustrated in FIGS. 1A to 7D, universal mechanical isolator 100 generally has a low profile with an overall height 256 (FIG. 5C) of only about 2 inches. First rigid piece 112 has a general low profile height 260 (FIG. 7A) of about ¾ inches and a wide base 264 (FIG. 7C) of about 1.5 inches. Second rigid piece 114 also has a general low profile height 262 (FIG. 7B) of about ¾ inches and the same, identical wide base 264 (FIG. 7C) of about 1.5 inches. The low profile heights, and a wide base (including connectivity by thread 124 at distal peripheries as detailed below) significantly contribute to the overall strength and stability of universal mechanical isolator 100. This is especially critical when universal mechanical isolator 100 is used sideways (as shown in FIG. 2C) with a heavy microphone 102 attached.

As illustrated in FIGS. 1A to 7D, first rigid piece 112 further includes a third mechanical connection 134 for mechanically connecting and fixing first rigid piece 112 to a first side 136 of resilient middle piece 106 by thread 124. Second rigid piece 114 further includes a fourth mechanical connection 138 for mechanically connecting and fixing second rigid piece 114 to a second side 140 of resilient middle piece 106 by thread 124. Third and fourth mechanical connections 134 and 138 may be identical.

First rigid piece 112 is further comprised of a first base 142, with the first mechanical connection 116 comprising a first, solid cylindrical projection 186 that extends from first base 142 of first side 126 of first rigid piece 112. First, solid cylindrical projection 186 includes a first portion 144 (the base of the cylinder 186) having a first outer diameter that has a shorter span than a second outer diameter 196 of a second portion 198 (the threaded part) of first cylindrical projection 186.

Span differential between first and second outer diameters of first and second portions 144 and 198 of cylindrical projection 186 form a first groove 146 positioned between first base 142 and a first end 200 of second portion 198 of first cylindrical projection 186. First base 142 need not be a rounded or circular disc, but may comprise of polygonal configuration.

A first auxiliary resilient member 148 (FIG. 4B) in a form of an o-ring is positioned within first groove 146. A periphery edge 150 (FIGS. 3D and 3F) of a support connection portion of adapter support 108 rests and presses against first auxiliary resilient member 148 rather than contacting first base 142 of first side 126 of first rigid piece 112 and hence, further absorbing and preventing transmission of any potential mechanical vibration. Accordingly, first auxiliary resilient member 148 prevents the contact between two rigid parts (and hence, preventing or dampening transfer of mechanical vibration from one rigid part to the next). That is, instead of adapter support 108 directly contacting first base 142 where vibration would be easily traversed (or transferred), they both contact first auxiliary resilient member 148, which dampens any potential mechanical vibrations. An outer circumferential surface of the second portion 198 (of cylinder 186) is threaded, forming male threaded connector portion 116.

As indicated above, first rigid piece 112 is comprised of first base 142 that includes third mechanical connection 134 for mechanically connecting and fixing first rigid piece 112 to first side 136 of resilient middle piece 106. Third mechanical connection 134 is comprised of at least one first opening 152 through which first rigid piece 112 is threaded (or stitched or sewn) to resilient middle piece 106 and second rigid piece 114 by thread 124 (best illustrated in FIGS. 5A to 6C).

In this non-limiting, embodiment, third mechanical connection 134 is preferably comprised of a plurality of first openings 152, positioned along near a first raised periphery edge 154 of first base 142 in a rounded or circular arrangement, equally distant from first center of first base 142, which may be in a form of a circular disc, with first rigid piece 112 fixed to resilient middle piece 106 by thread 124 through the plurality of first openings 152.

First base 142 is a first disc with plurality of first openings 152 positioned in a circular arrangement, equally distant from first center of first disc, near first raised periphery edge 154. Plurality of first openings 152 are positioned in a circular arrangement, equally distant from first center of first base 142, near first, raised periphery edge 154, aligned within an optional trough 156 on first side (or top or outer side) 126 of first base 142.

As illustrated, thread 124 is cradled within trough 156, passed through plurality of first openings 152 connecting first rigid piece 112 with resilient middle piece 106 and second rigid piece 114. Trough 156 has sufficient depth for protecting thread 124 and hence, the integrity of the connection that fixes first rigid piece 112, second rigid piece 114, and resilient middle piece 106 together. Trough 156 has a generally central longitudinal axis that extends through center of openings 152, forming a rounded or closed loop trough. It should be noted that a first finish cap (or covering) 158 shown in FIG. 4B is positioned on top of trough 156 to further protect thread 124, with first o-ring 148 having a further holding power on top of finish cap 158. First cap is comprised of a non-rigid vinyl.

A second side 130 or 132 of first or second base 142 or 166 (FIGS. 7C and 7D) is generally flat (optionally, it may comprise of uneven (or abrasive) surface), pressing against a commensurately correspondingly configured, flat or uneven first or second side 136 or 140 of resilient middle piece 106. Second side 130 or 132 of first or second base 142 includes a raised center hub 162 protruding from second side 130 or 132 of first or second base 142 at a height 246 of about 1/16 inch. It should be noted that a protective trough is not required on second sides 130 and 132 of first and second base 142 and 166 because thread 124 is threaded through resilient middle piece 106 (generally perpendicular sides 136 and 140) and into and passing through resilient middle piece 106, as best shown in FIGS. 5A to 6C.

As best illustrated in FIG. 5C, center hub 162 with a diameter 248 of about ½ inch is a projection 246 (of about 1/16 inch) that is axially received within a center opening 164 of resilient middle piece 106. Center opening 164 is a through-opening that has an inner diameter 250 of about ½ inches. Sizes of diameter 248 of center hub 162 in relation to diameter 250 of center opening 164 is such that first and second rigid pieces 112 and 114 securely, and tightly friction-fit within resilient middle piece 106.

Center hub 162 serves the functions of "centering" and "interlocking" first and second rigid pieces 112 and 114 in relation to resilient middle piece 106, preventing lateral movement of resilient middle piece 106 in relation to first and second rigid pieces 112 and 114. It should be noted that raised center hub 162 provides additional surface area (due to its height 246 and width 248) through which vibration may be transmitted and better disbursed within and absorbed by resilient middle piece 106.

Referring back to FIG. 7B, second rigid piece 114 includes second mechanical connection 118 that is comprised of second cylindrical projection 202 that extends from first side 128 of second base 166 of second rigid piece 114. Second cylindrical projection 202 includes a first portion 204 (the base of the cylinder 202) having a second outer diameter that has a shorter span than a second outer diameter 208 of a second portion 206 of second cylindrical projection 202. Span differential between first and second outer diameters of second cylindrical projection 202 form a second groove 168 positioned between second base 166 and a first end (or edge) 210 of second portion 206 of second cylindrical projection 202.

An inner circumferential surface 170 of second portion 206 is threaded, forming female threaded connector, and a second auxiliary resilient member 160 (FIG. 4C) in a form of an o-ring is positioned within second groove 168. Second auxiliary resilient member 160 further secures cover 182 over openings 176 (detailed below).

A third auxiliary resilient member 172 (FIGS. 3B and 4D) in a form of an o-ring is positioned within interior and at a solid bottom 212 of second cylindrical projection 202. A distal edge 174 (FIG. 3B) of support connector 120 of support 104 rests and presses against third auxiliary resilient member 172 rather than directly contacting interior bottom 212 of second cylindrical projection 202 and hence, further absorbing transmission of any potential mechanical vibration. Accordingly, third auxiliary resilient member 172 prevents the contact between two rigid parts (and hence, transfer of mechanical vibration from one rigid member to the next). That is, instead of support connection 120 of support 104 directly contacting bottom 212 of second cylindrical projection 202 where vibration would be easily traversed or transferred, it contacts third auxiliary resilient member 172, which dampens any potential mechanical vibrations.

Second side 130 of first base 142 is fixed onto first side 136 of resilient middle piece 106 and second side 132 of the second based 166 is fixed onto the second side 140 of resilient middle piece 106 by thread 124. Plurality of first openings 152 of first base 142 are aligned with the plurality of second openings 176 of second base 166, with thread 124 threaded through resilient middle piece 106 and sewed and stitching through the aligned pluralities of first and second openings 152 and 176 (best shown in FIGS. 5A to 6C).

Second base 166 (identical to first base 142) is a second disc with plurality of second openings 176 positioned in a circular arrangement, equally distant from second center of second base 166, near second raised periphery edge 178. Plurality of second openings 176 are positioned in a circular arrangement, equally distant from second center of second base 166, near second raised periphery edge 178, aligned within an optional trough 180 on first side (or top or outer side) 128 of second base 166.

Plurality of first and second openings 152 and 176 are aligned with respect to one another and further, are equally positioned away from their respective centers of bases 142 and 166, and as close to periphery edge 154 and 178 as possible, contributing to the overall strength and stability of universal mechanical isolator 100. This is especially critical when using universal mechanical isolator 100 sideways (best shown in FIG. 2C) with a heavy microphone attached. In other words, the connectivity described adds to the overall structural integrity and strength by reducing extreme lateral or tilting movement 254 (FIG. 5C) of the rigid pieces in relation to central longitudinal axis 252 of universal mechanical isolator 100.

Trough 180 has a generally central longitudinal axis that extends through center of openings 176, forming a rounded or closed loop trough. It should be noted that a second finish cap 182 (FIG. 4C) is positioned on top of second trough 180 to further protect thread 124, with the second o-ring 160 having a further holding power on top of the second finish cap 180. Second cap is also comprised of a non-rigid vinyl.

Thread 124 is threaded through one of the plurality of first openings 152 or the plurality of second openings 176, then through resilient middle piece 106, and threaded through the other of the plurality of second openings 176 or the plurality of first openings 152. Thread 124 is threaded through a first of the plurality of first openings 152, then through resilient middle piece 106, and threaded through a first opening of plurality of correspondingly aligned second openings 176, thus literally sewing or stitching first rigid piece 112, resilient middle piece 106, and second rigid piece 114 together. The present invention defines a "stitch" as loop(s) of thread or yarn resulting from one or more pass or movement of an instrument in sewing. The threading of the thread 124 may comprise of several passes through all openings and resilient middle piece to provide a multi-loop thread to increase overall holding strength of universal mechanical isolator 100*a*.

In general, thread 124 is of a high tensile strength to maintain the hold-integrity of universal mechanical isolator 100*a*, even if weight of vibration sensitive device 102 is supported laterally (or sideways as shown in FIG. 2C). Thread 124 may comprise of any well-known industrial nylon or Kevlar, preferably with a tensile strength of greater than about 23 pounds. This assures the integrity of the assembly of universal mechanical isolator 100 when a heavy vibration sensitive device 102 (e.g., upwards of 50 plus ounces) is supported, even when device 102 is held in sideways. In fact, any thread that maintains non-rigid, soft, but strong connection may be used. Therefore, the higher the tensile strength of thread 124 the better since it may support more weight. Also, the higher the number of loops (stitching) of the thread 124 the better, which adds to the overall structural or assembled integrity of universal mechanical isolator 100.

Resilient middle piece 106 absorbs and dampens vibration forces between support adapter 108 and support 104, regardless of the orientation of vibration sensitive device 102. This frees vibration sensitive device 102 to be positioned at any orientation allowed by support 104 while universal mechanical isolator 100 effectively decouples vibration sensitive device 102 from support 104 to thereby isolate vibration sensitive device 102 from mechanical vibrations; That is, the vibration energy is dissipated within resilient middle piece 106.

It should be noted that since there is no rigid connection between first and second rigid pieces 112 and 114 (i.e., the first and second rigid pieces 112 and 114 do not directly or indirectly contact each other through any rigid element), then there is no transmission or transfer of vibration from one of the first or second rigid piece 112 or 114 to the other of the second or first rigid piece 114 or 112. Use of rigid connectivity (non-limiting example of which may include the use of fasteners such as screws) may aid in transfer of vibration forces whereas thread 124 and soft material impede or stop or dampen and prevent transfer of vibration forces by absorbing the vibrations forces.

In addition, it is important that universal mechanical isolator 100 is comprised of three pieces rather than molded from a single piece. Use of multiple pieces (e.g., rigid pieces 112, 114, and resilient middle piece 106) facilitate in further isolating potential vibrations of one piece (e.g., first rigid piece 112) to be transferred to another (second rigid piece 114). Use of threaded connectivity using thread 124 further dampens any potential vibrations from any one rigid piece 112 or 114.

Resilient middle piece 106 is comprised of a flexible an annular disc (FIG. 6D) with about 30 to 75 durometer value having first side 136, second side 140, and a low profile lateral side 258 of height of about 0.85 inch to about 1.0 inch. Resilient middle piece 106 further includes a central opening 164, with first side 136 and second side 140 configured commensurate with first base 142 and second base 166 of first rigid piece 112 and second rigid piece 114. Resilient middle piece 106 may have a larger expanse than either the first or second base 142 and 166 of respective first or second rigid pieces 112 and 114 (FIGS. 1A, 1B, and 5A to 5C). As best illustrated in FIG. 1B or FIG. 5A to 5C, overall diameter 216 of resilient middle piece 106 extends passed first and second rigid piece 112 and 114 (as indicated by arrows 214).

It should be noted that it is preferred that the non-rigid resilient middle piece 106 to have at least as large an expanse as the area of first and or second base 142 and 166 of respective first or second rigid piece 112 and 114. This way, rigid first and second bases 142 and 166 of respective first and second rigid piece 112 and 114 always are in full contact with respective first and second side 136 and 140 of non-rigid resilient middle piece 106 for maximum absorption and efficient disbursement of transmitted vibrations from first and second rigid pieces 112 and 114—that is, maximum dissipation of vibration energy within resilient middle piece 106. Center opening 164 of annular disc shaped resilient middle piece 106 may be equal or slightly smaller then the diameter size of centering hub 162, which may facilitate a better hold (friction or press) fit.

FIGS. 8A to 8D are non-limiting, exemplary illustrations of a universal mechanical isolator in accordance with another embodiment of the present invention where trough is polygonal. Universal mechanicals isolator 100*b* illustrated in FIGS. 8A to 8D includes similar corresponding or equivalent components, interconnections, functional, operational, and or cooperative relationships as the device 100*a* that is shown in FIGS. 1A to 7D, and described above. Therefore, for the sake of brevity, clarity, convenience, and to avoid duplication, the general description of FIGS. 8A to 8D will not repeat every corresponding or equivalent component, interconnections, functional, operational, and or cooperative relationships that has already been described above in relation to universal mechanical isolator 100*a* that is shown in FIGS. 1A to 7D but instead, are incorporated by reference herein.

As illustrated in FIGS. 8A to 8D, in this non-limiting, exemplary instance, the troughs 802 and 804 on first sides 126 and 128 of first and second rigid pieces 112 and 114 of universal mechanical isolator 100*b* form a polygonal configuration rather than being continuously circular. Since a tightly stitched thread section 218 of thread 124 extends naturally linearly, troughs 802 and 804 polygonal configurations better accommodate each thread section 218. Angle 220 between each trough section 222 of troughs 802 and 804 may be varied.

Figure 9:
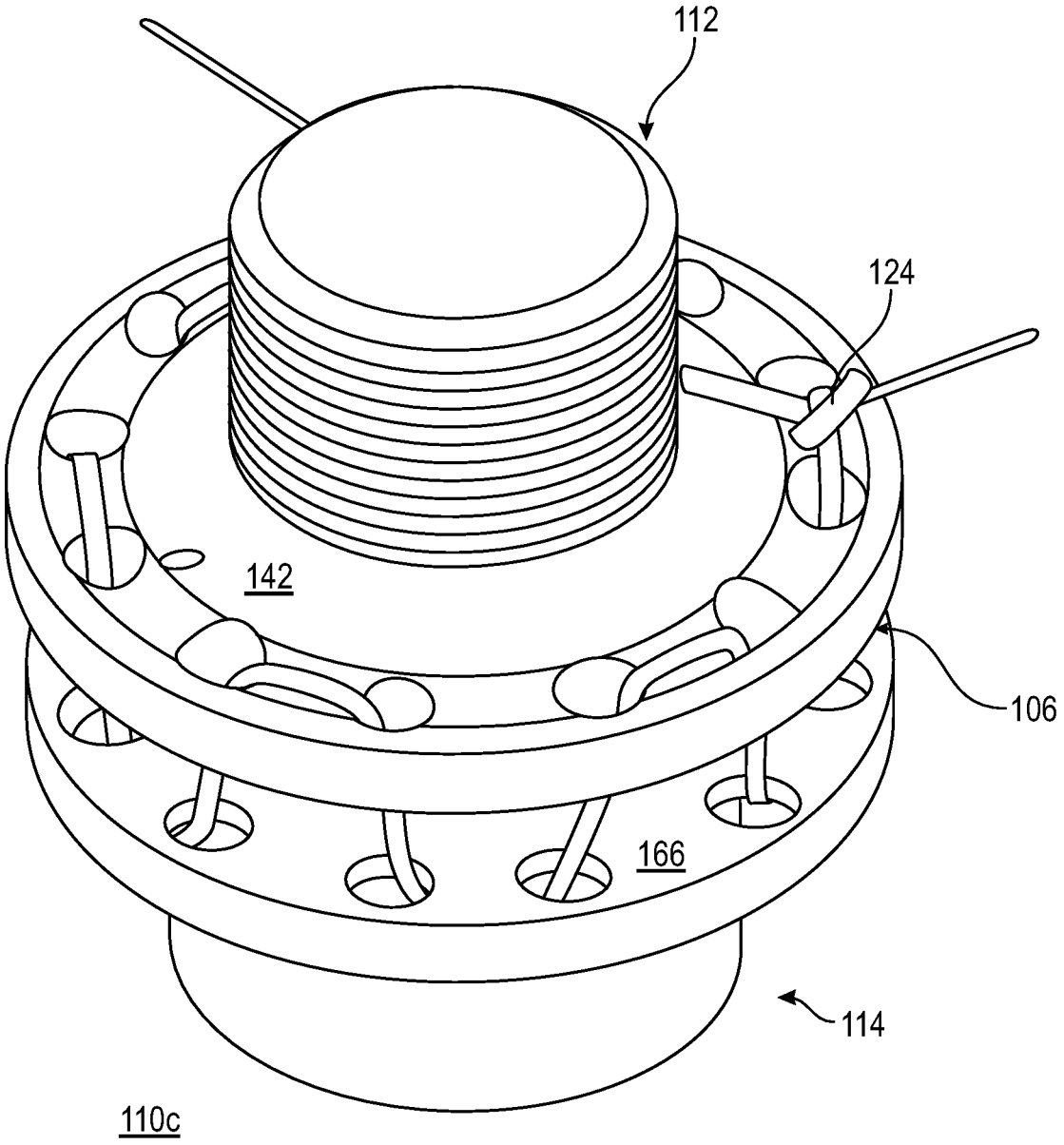
FIG. 9 is a non-limiting, exemplary illustration of a universal mechanical isolator in accordance with one or more embodiments of the present invention.
Figure 10A:
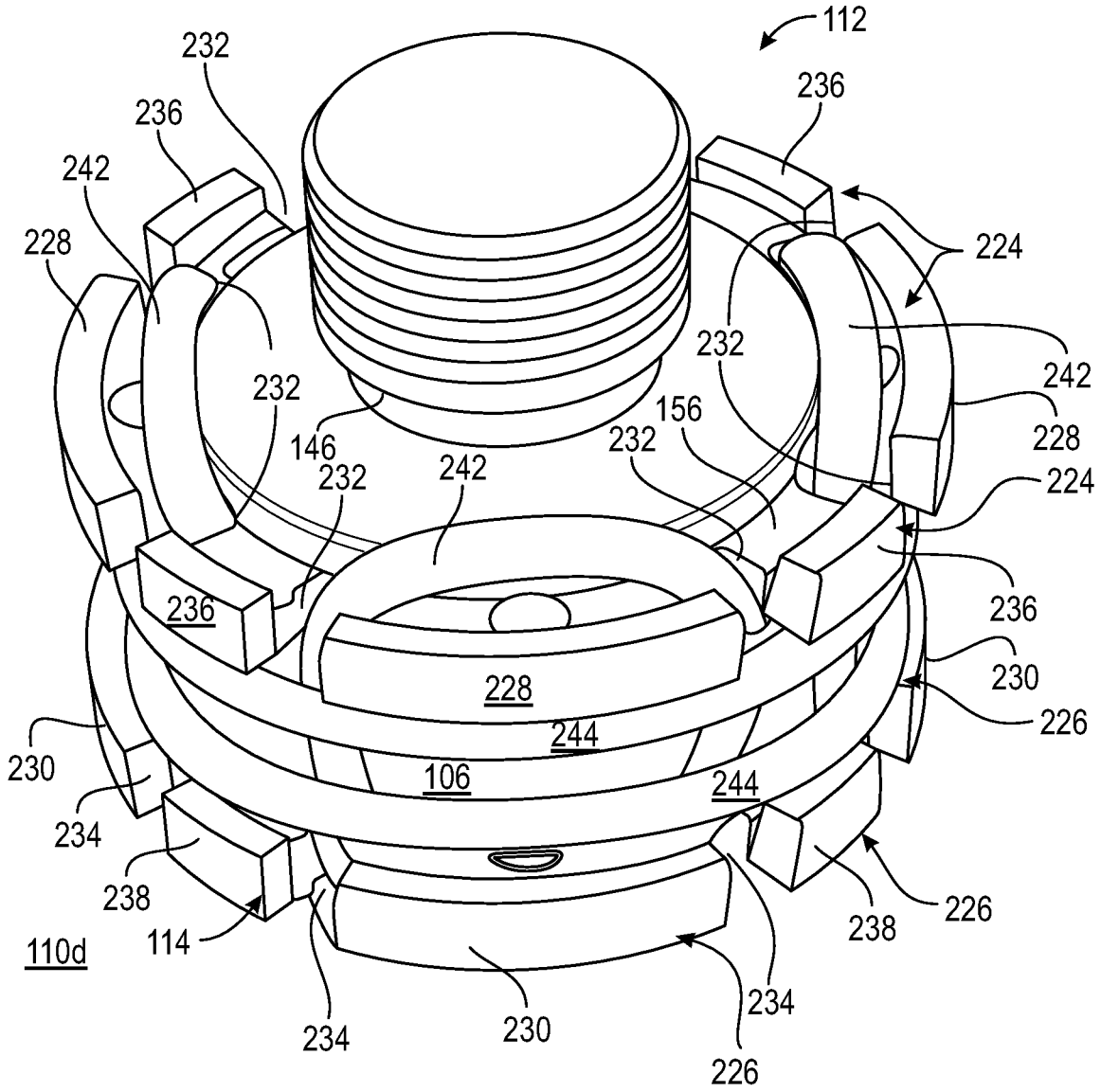
FIGS. 10A to 10F are non-limiting, exemplary illustration of a universal mechanical isolator in accordance with one or more embodiments of the present invention.
Figure 10B:
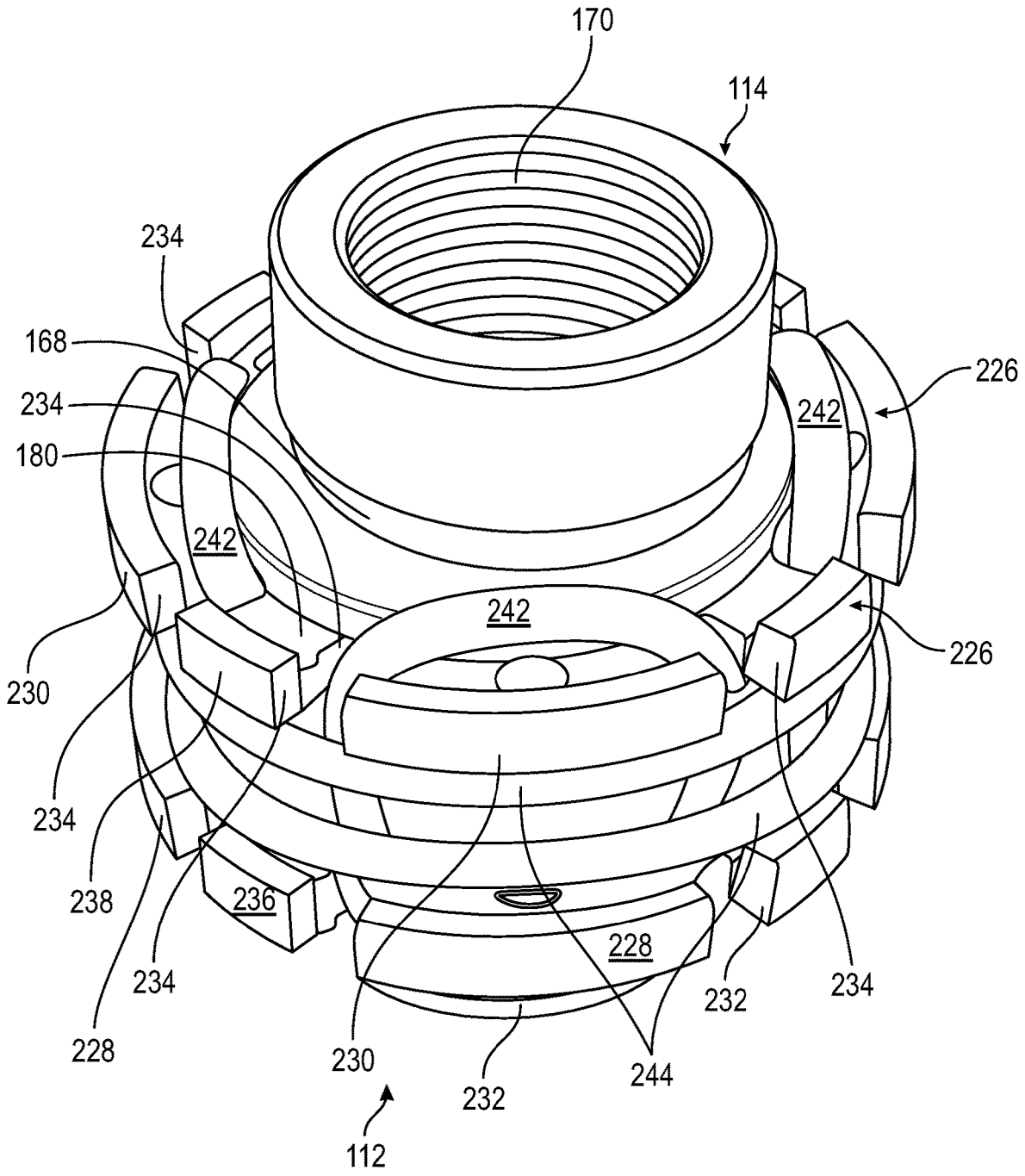
Figure 10C:
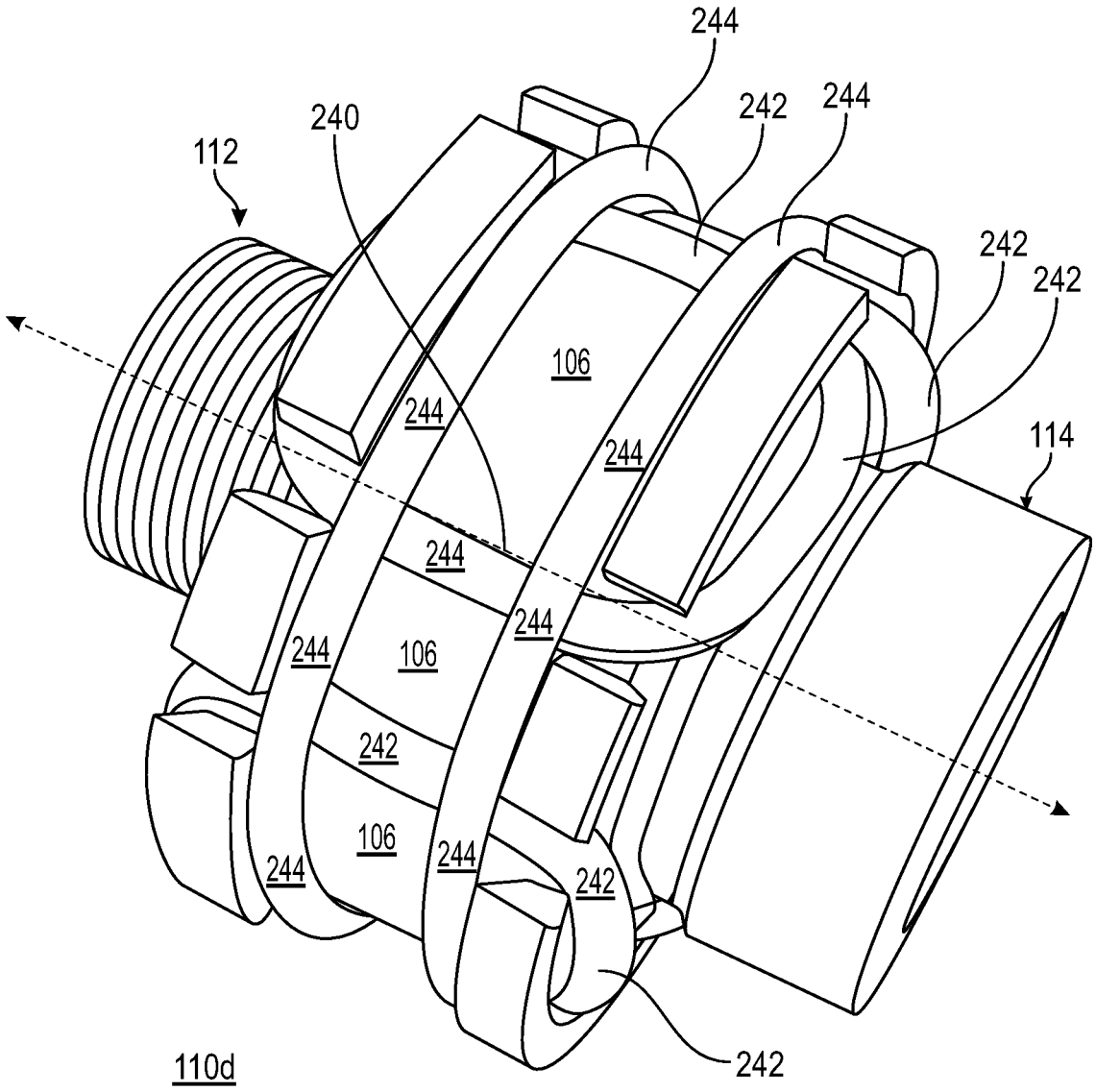
Figure 10D:
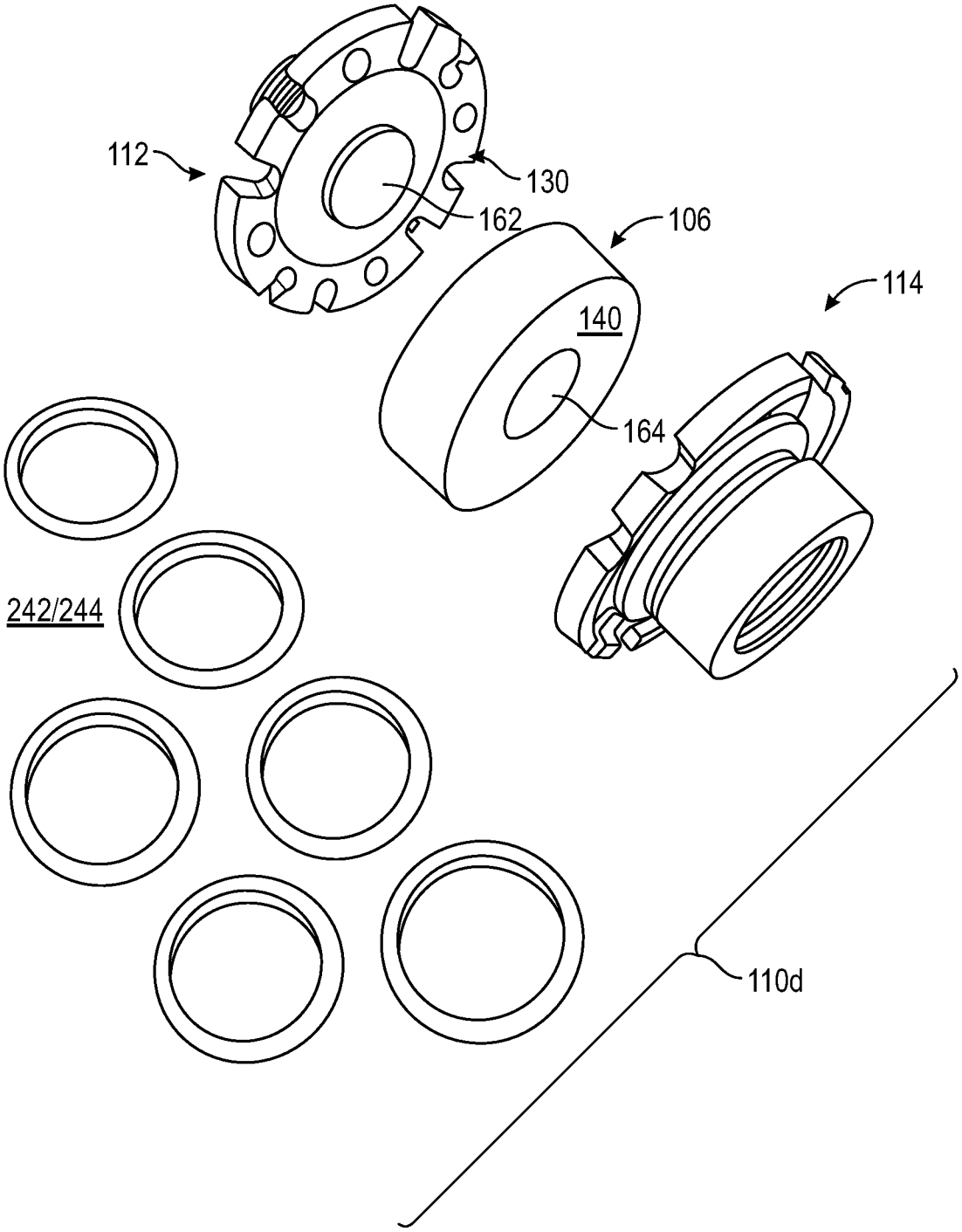
Figure 10E:
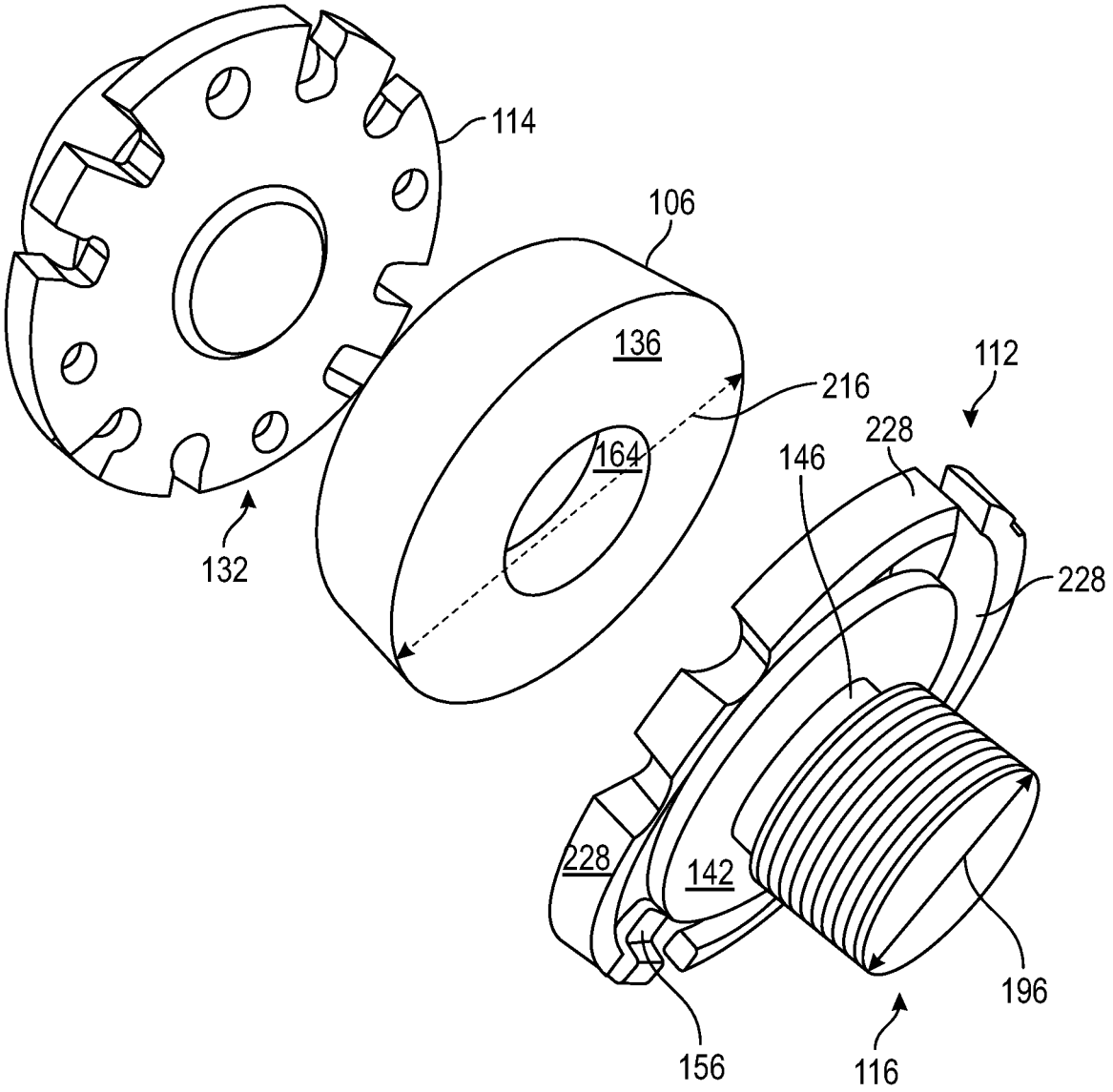
Figure 10F:
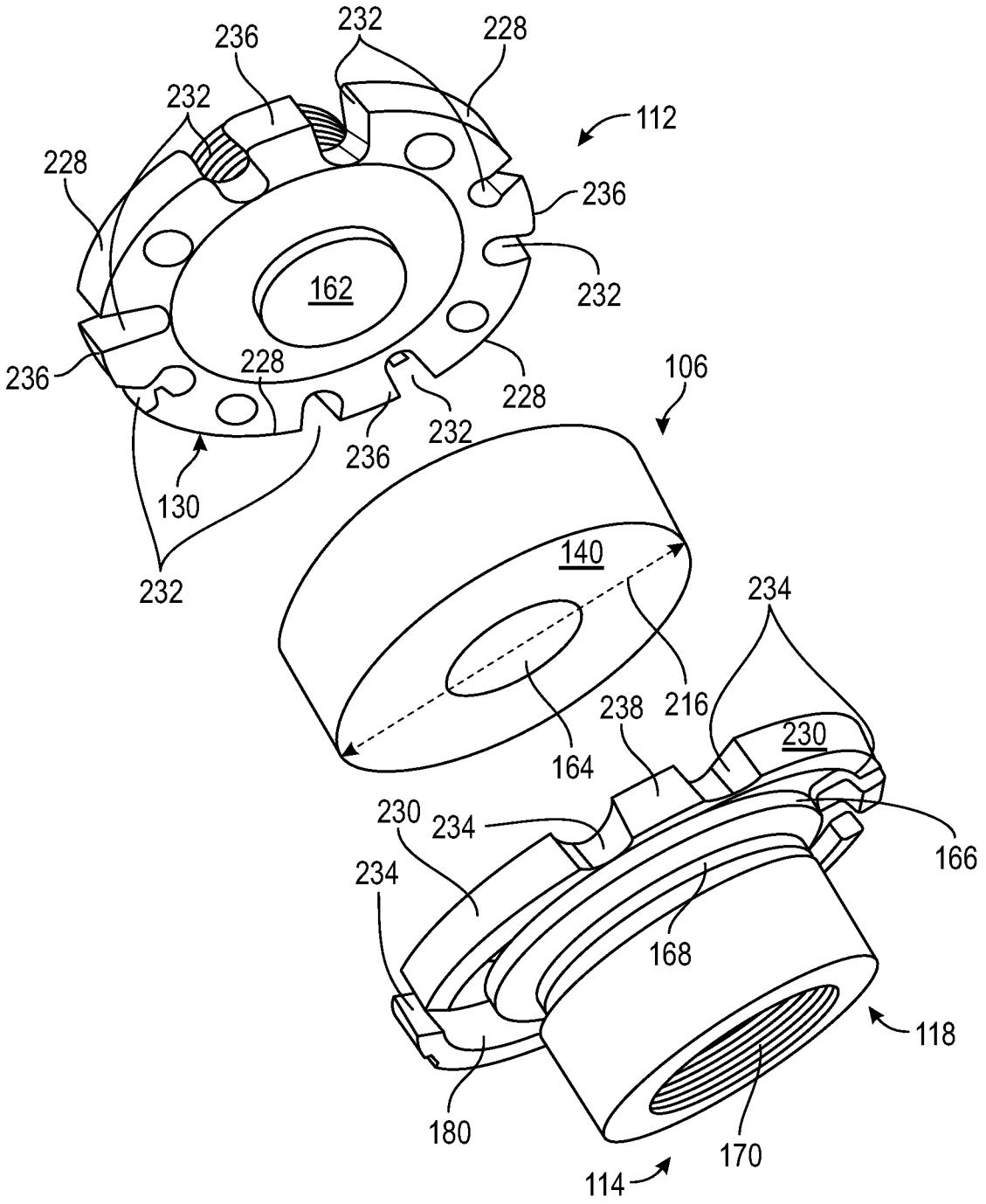

FIG. 9 is a non-limiting, exemplary illustration of a universal mechanical isolator in accordance with another embodiment of the present invention where resilient middle piece is smaller in diameter than first and second members. Universal mechanicals isolator 100*c* illustrated in FIG. 9 includes similar corresponding or equivalent components, interconnections, functional, operational, and or cooperative relationships as universal mechanical isolator 100*a* and 100*b* that are shown in FIGS. 1A to 8D, and described above. Therefore, for the sake of brevity, clarity, convenience, and to avoid duplication, the general description of FIG. 9 will not repeat every corresponding or equivalent component, interconnections, functional, operational, and or cooperative relationships that has already been described above in relation to universal mechanical isolator 100*a* and 100*b* that are shown in FIGS. 1A to 8D but instead, are incorporated by reference herein.

As indicated above, diameters of first base 142 of first rigid piece 112 and second base 166 of second rigid piece 114 may be equal to, greater than, or less than diameter 216 of middle, resilient piece 106. FIG. 9 is non-limiting, exemplary illustration of a universal mechanical isolator 100*c* in accordance with another embodiment of the present invention where middle piece 106 is smaller in diameter than diameters of first and second bases 142 and 166 of first and second rigid pieces 112 and 114.

FIGS. 10A to 10F are non-limiting, exemplary illustrations of a universal mechanical isolator in accordance with another embodiment of the present invention where o-rings are used to detachably assemble a universal mechanical isolator 100*d*. Universal mechanicals isolator 100*d* illustrated in FIGS. 10A to 10F includes similar corresponding or equivalent components, interconnections, functional, operational, and or cooperative relationships as universal mechanical isolator 100*a*, 100*b*, and 100*c* that are shown in FIGS. 1A to 9, and described above. Therefore, for the sake of brevity, clarity, convenience, and to avoid duplication, the general description of FIGS. 10A to 10F will not repeat every corresponding or equivalent component, interconnections, functional, operational, and or cooperative relationships that has already been described above in relation to universal mechanical isolator 100*a*, 100*b*, and 100*c* that are shown in FIGS. 1A to 9 but instead, are incorporated by reference herein.

In this non-limiting, exemplary embodiment, first rigid piece 112, second rigid piece 114, and resilient middle piece 106 are detachably coupled by multiple couplers, non-limiting examples of which may be well known flexible o-rings. The detachable scheme disclosed in FIGS. 10A to 10F enables users to easily disassemble and reassemble universal mechanical isolator 100*d* to interchange parts such as changing one resilient middle piece 106 with a first durometer value with another resilient middle piece 106 with a second durometer value.

As illustrated in FIG. 10A to 10F, first rigid piece 112, second rigid piece 114, and resilient middle piece 116 may be detachably coupled by a set of flexible o-ring type rubber 242/244 instead of being fixed and held together by a sewed thread 124. In general, universal mechanical isolator 100*d* may be used with lightweight equipment since its various parts are not fixed together by thread 124 but instead are detachable held together by flexible o-rings 242/244.

As illustrated, in this non-limiting, exemplary instance, universal mechanical isolator 100*d* has first and second rigid pieces 112 and 114 having respective first and second distal periphery edges 224 and 226, sectionalized by respective first and second set of lateral notch-pairs 232 and 234. Since the second distal periphery edges 224 and 226 are sectionalized, respective troughs 156 and 180 are also sectionalized.

In this non-limiting, exemplary instance, respective first and second rigid pieces 112 and 114 of universal mechanical isolator 110*d* have four first connector sections 228 and four second connector sections 230 defined by respective four pairs of first and second set of lateral notch-pairs 232 and 234. First and second set of lateral notch-pairs 232 and 234 are recesses between a connection section 228 and 230 and adjacent, securing sections 236 and 238.

As further illustrated, a first set of o-rings 242 are positioned within first and second set of lateral notch-pairs 232 and 234, mounted on first and second connection sections 228 and 230, oriented generally parallel along a longitudinal axis 240 of universal mechanical isolator 110*d*, parts of which are cradled within respective troughs 156 and 180. Once first set of o-rings 242 are mounted, a second set of identical o-rings 244 are mounted over the first set 242, but positioned circumferentially around resilient middle piece 106 between connection sections 228 and 230 and securing sections 236 and 238, generally transverse longitudinal axis 240 of universal mechanical isolator 110*d*. First and second set of o-rings 242 and 244 may be identical and may comprise of generally soft silicon-based rubber (o-rings). It should be noted that in this non-limiting, exemplary embodiment, first and second rigid pieces 112 and 114 also include all of the additional o-rings (148, 160, and 172) disclosed above for previous embodiments (all disclosed o-rings throughout the disclosure being identical), but not shown for clarity.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Further, the specification is not confined to the disclosed embodiments. Therefore, while exemplary illustrative embodiments of the invention have been described, numerous variations and alternative embodiments will occur to those skilled in the art. For example, other materials may be used for the universal mechanical isolator so long as the universal mechanical isolator and in particular, resilient middle piece and connections (threads or o-rings) that holds the pieces together maintain their soft, pliable property for continued absorption of vibration energy. As another example, first rigid piece 112 may be stitched to first side 136 of resilient middle piece 106 and second rigid piece 114 may be stitched to the other side 140 of same resilient middle piece 106 rather than the use of a single thread 124 for all. However, it is preferred if a single thread 124 is used as it would simplify the overall manufacturing process. Such variations and alternate embodiments are contemplated, and can be made without departing from the spirit and scope of the invention.

It should further be noted that throughout the entire disclosure, the labels such as left, right, front, back, top, inside, outside, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction, orientation, or position. Instead, they are used to reflect relative locations/positions and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

Further the terms "a" and "an" throughout the disclosure (and in particular, claims) do not denote a limitation of quantity, but rather denote the presence of at least one of the referenced item.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A vibration dampening device, comprising:

a universal mechanical isolator that effectively decouples a vibration sensitive device from a support to thereby isolate the vibration sensitive device from mechanical vibrations;

the universal mechanical isolator includes:

a first rigid piece associated with the vibration sensitive device;

a second rigid piece associated with the support; and a resilient middle piece that is positioned between and connected and sewn to the first rigid piece and to the second rigid piece by a thread, with the resilient middle piece absorbing mechanical vibrations.

2. The vibration dampening device as set forth in claim 1, wherein:

the resilient middle piece is a non-rigid, flexible piece with a durometer value of 30 to 75.

3. The vibration dampening device as set forth in claim 1, wherein:

the first rigid piece includes a first mechanical connection for detachably coupling the first rigid piece with an adapter support, with the vibration sensitive device detachably mounted on the adapter support.

4. The vibration dampening device as set forth in claim 1, wherein:

the second rigid piece includes a second mechanical connection for detachably coupling with the support.

5. The vibration dampening device as set forth in claim 1, wherein:

the resilient middle piece is sewn to the first and the second rigid pieces by the thread along a distal periphery edges of the first and the second rigid pieces.

6. The vibration dampening device as set forth in claim 3, wherein:

the first rigid piece further includes a third mechanical connection along distal periphery of the first rigid piece for mechanically connecting and fixing the first rigid piece to a first side of the resilient middle piece.

7. The vibration dampening device as set forth in claim 4, wherein:

the second rigid, piece further includes a fourth mechanical connection along distal periphery of the second rigid piece for mechanically connecting and fixing the second rigid piece to a second side of the resilient middle piece.

8. The vibration dampening device as set forth in claim 4, wherein:

the first rigid piece, the second rigid piece, and the resilient middle piece are detachably coupled together.

9. The vibration dampening device as set forth in claim 1, wherein:

a second side of the first and second rigid pieces is generally flat, pressing against a respective first and second side of the resilient middle piece;

the second side of the first and second rigid pieces includes:

a center hub protruding from the second side;

the center hub is axially received within a center opening of the resilient middle piece.

10. A vibration dampening device, comprising:

a universal mechanical isolator that effectively decouples a microphone from a microphone stand to thereby isolate the microphone from mechanical vibrations;

the universal mechanical isolator includes:

a first rigid piece associated with the microphone;

a second rigid piece associated with the microphone stand; and a resilient middle piece that is positioned between and connected to the first rigid piece and to the second rigid piece, with the resilient middle piece absorbing mechanical vibrations;

the resilient middle piece is mechanically connected and fixed to the first and the second rigid pieces by a thread along a periphery edge of the first and the second rigid piece.

11. The vibration dampening device as set forth in claim 10, wherein:

the first rigid piece and second rigid piece include:

a base that includes a mechanical connection for mechanically connecting and fixing the first rigid piece to a first side of the resilient middle piece and the second rigid piece to a second side of the resilient middle piece;

the mechanical connection of the first and second rigid piece is comprised of a plurality of openings, positioned along near a periphery edge of the base in a circular arrangement, equally distant from a center of the base;

with the first rigid piece and the second, rigid piece fixed to the resilient middle piece by a thread that is sewn through the plurality of the openings.

12. The vibration dampening device as set forth in claim 10, wherein:

centers of first and second rigid pieces are solid.

13. The vibration dampening device as set forth in claim 10, wherein:

one of the first rigid piece and the second rigid piece include a first projection with an outer diameter threading forming a solid male connector, and the other one of the second rigid piece and the first rigid piece includes a second projection with inner diameter threading, forming a solid female connector.

14. The vibration dampening device as set forth in claim 10, wherein:

a second side of the base is generally flat, pressing against side of the resilient middle piece;

the second side of the base includes:

a center hub protruding from the second side;

the center hub is axially received within a center opening of the resilient middle piece.

15. The vibration dampening device as set forth in claim 10, wherein:

the resilient middle piece is a low profile member comprised of:

an annular disc having a first side, a second side, a lateral, and a central opening, with the first side and the second side configured commensurate with the first base and the second base of the first rigid piece and the second rigid piece.

16. A vibration dampening device, comprising:

a universal mechanical isolator that effectively decouples a microphone from a microphone stand to thereby isolate the microphone from mechanical vibrations;

the universal mechanical isolator includes:

a first rigid piece associated with the microphone;

a second rigid piece associated with the microphone stand; and a low profile resilient middle piece that is positioned between and connected to the first rigid piece and to the second rigid piece, with the resilient middle piece absorbing mechanical vibrations;

the first rigid piece and the second rigid piece include a base with plurality of openings positioned in a circular arrangement and aligned within a trough on a first side of the base;

the resilient middle piece is mechanically connected and fixed to the first and the second rigid pieces by a thread that is sewn through the plurality of the openings.

17. The vibration dampening device as set forth in claim 16, wherein:

a second side of base is generally flat, pressing against side of the resilient middle piece;

the second side of the base includes:

a center hub protruding from the second side;

the center hub is axially received within a center opening of the resilient middle piece.

18. The vibration dampening device as set forth in claim 16, wherein:

the resilient middle piece is comprised of:

an annular disc having a first side, a second side, a lateral side, and a central opening, with the first side and the second side configured commensurate with the first base and the second base of the first rigid piece and the second rigid piece.

19. The vibration dampening device as set forth in claim 16, wherein:

one of the first rigid piece and the second rigid piece includes a first projection with an outer diameter threading forming a male connector, and the other one of the second rigid piece and the first rigid piece includes a second projection with inner diameter threading, forming a female connector.

20. The vibration dampening device as set forth in claim 16, wherein:

the thread is cradled within the trough, passed through the plurality of openings connecting the first rigid piece and the second rigid piece with the resilient middle piece.

* * * * *